United States Patent [19]

Plange

[11] Patent Number: 4,890,842

[45] Date of Patent: Jan. 2, 1990

[54] BOARD GAME APPARATUS

[76] Inventor: Wim C. Plange, 2225 NE. 16th Ave., Wilton Manors, Fla. 33305

[21] Appl. No.: 268,875

[22] Filed: Nov. 8, 1988

[51] Int. Cl.[4] ..... A63F 3/00

[52] U.S. Cl. ..... 273/246; 273/254; 273/256

[58] Field of Search ..... 273/246, 251, 252, 256, 273/274, 278, 254

[56] References Cited

U.S. PATENT DOCUMENTS

| | | | |
|---|---|---|---|
| 3,109,652 | 11/1963 | Strand | 273/256 |
| 3,679,210 | 7/1972 | Breslow | 273/256 |
| 3,889,954 | 6/1975 | Malisow | 273/274 |
| 4,082,284 | 4/1978 | Jennings | 273/251 |
| 4,426,084 | 1/1984 | Michel | 273/254 |

FOREIGN PATENT DOCUMENTS

| | | | |
|---|---|---|---|
| 922772 | 3/1963 | United Kingdom | 273/251 |
| 2078118 | 1/1982 | United Kingdom | 273/256 |

*Primary Examiner*—Edward M. Coven
*Assistant Examiner*—Benjamin Layno
*Attorney, Agent, or Firm*—Walter F. Wessendorf, Jr.

[57] ABSTRACT

A high-risk racing game in which two to six players own racing cars represented by their pawns which they race along routes of enumerated spaces through the United States, Canada and Mexico on a gameboard. Players are given the cars, or purchase them outright or at auction by total cash or part payment with the balance financed against a car's credit limit. A player defrays incurred expenses by cash payment or debt charged against an owned car. The first player with 100 points on the scoreboard wins the game. The scoreboard records points accumulated by players, cars owned outright and purchased, and cars available for acquisition. Each time a player lands upon or passes the gameboard's score-line space, he collects points for cars he owns, with additional points collected for two-car racing teams of each specific group. The number of gameboard spaces a player advances his pawn corresponds to a number card picked or a certain space landed upon. Landing upon certain gameboard spaces requires a player to pick a rallye card which imposes duties or penalties requiring expenses to be defrayed, provides rewards or bonuses, or exercisable options. A player, landing upon a gameboard crash space, loses a car. The unknown factors of the operative effects of the rallye cards provide excitement and apprehension because the last ranking player in the race may become the leader, and even a player forced into bankruptcy may recover to win the race.

17 Claims, 38 Drawing Sheets

```
 1=START
 2=COLORED SPACE
 3=PITTSBURGH,IMPORT CITY
   CAR GROUP # 9,ENGLISH
   CARS:ROLLS ROYCE,JAGUAR
 4=MOVE 14 SPACES FORWARD
 5=COLORED SPACE
 6=COLORED SPACE
 7=MOVE 14 SPACES FORWARD
 8=COLORED SPACE
 9=COLORED SPACE
10=MOVE 15 SPACES FORWARD
11=MEMPHIS (CITY)
12=COLORED SPACE
13=COLORED SPACE
14=NEW ORLEANS,IMPORT CITY
   CAR GROUP # 3,FRENCH
   CARS:PEUGEOT,RENAULT
15=MOVE 16 SPACES FORWARD
16=AUCTION,(ONE CAR)
17=COLORED SPACE
18=ATLANTA (CITY)
19=MOVE 15 SPACES FORWARD
20=MOVE 16 SPACES FORWARD
21=TAMPA (CITY)
22=COLORED SPACE
23=MIAMI,IMPORT CITY
   CAR GROUP # 12,ITALIAN
   CARS:MASERATTI,DE TOMASO
24=BORDER
25=NASSAU (CITY),BAHAMAS
26=COLORED SPACE
27=MOVE 16 SPACES FORWARD
28=JACKSONVILLE,IMPORT
   CITY,CAR GROUP # 11,
   GERMAN CARS:PORSCHE,MERCEDES
29=COLORED SPACE
30=COLORED SPACE
31=CHARLESTON (CITY)
32=COLORED SPACE
33=SPONSOR PAYS $7,000
34=CHARLOTTE (CITY)
35=COLORED SPACE
36=WASHINGTON (CITY)
37=PHILADELPHIA (CITY)
38=COLORED SPACE
39=NEW YORK,IMPORT CITY
   CAR GROUP # 13,ENGLISH
   CARS:ASTON MARTIN,LOTUS
40=COLORED SPACE
41=BOSTON,IMPORT CITY
   CAR GROUP # 7,ENGLISH
   CARS:MORGAN,STERLING
42=COLORED SPACE
43=BORDER
44=COLORED SPACE
45=HALIFAX,IMPORT CITY
   CAR GROUP # 5,SWEDISH
   CARS:VOLVO,SAAB
46=COLORED SPACE
47=MOVE 17 SPACES FORWARD
48=COLORED SPACE
49=MOVE 15 SPACES FORWARD
50=COLORED SPACE
51=MOVE 13 SPACES FORWARD
52=MONTREAL,MANUFACTURER
   CAR GROUP # 6,CANADIAN
   CARS:BRICKLIN NO.1+2
53=COLORED SPACE
54=COLORED SPACE
55=COLORED SPACE
56=COLORED SPACE
57=COLORED SPACE
58=MOVE 13 SPACES FORWARD
59=MOVE 12 SPACES FORWARD
60=COLORED SPACE
61=COLORED SPACE
62=MOVE 14 SPACES FORWARD
63=COLORED SPACE
64=WINNIPEG (CITY)
65=COLORED SPACE
66=MOVE 11 SPACES FORWARD
67=SPONSOR PAYS $20,000
68=COLORED SPACE
69=COLORED SPACE
70=MOVE 9 SPACES FORWARD
71=CALGARY (CITY)
72=COLORED SPACE
73=COLORED SPACE
74=COLORED SPACE
75=VANCOUVER,IMPORT CITY
   CAR GROUP # 1,RUSSIAN
   CARS:MOSKOVICH,VOLGA
76=BORDER
77=SEATTLE (CITY)
78=COLORED SPACE
79=PORTLAND (CITY)
80=MOVE 1 SPACE FORWARD
81=CRASH(LOOSE ONE CAR)
82=CRASH(LOOSE ONE CAR)
83=COLORED SPACE
84=SAN FRANCISCO,IMPORT
   CITY,CAR GROUP # 2,
   KOREAN CARS:HYUNDAI NO.1+2
85=COLORED SPACE
86=COLORED SPACE
87=LOS ANGELES,IMPORT CITY
   CAR GROUP # 4,JAPANESE
   CARS#MISSAN,TOYOTA
88=SAN DIEGO (CITY)
89=COLORED SPACE
90=LAS VEGAS,GAMBLE FOR POINTS
91=SHORTCUT,PAY $5,000
   TO USE OR CONTINUE ON
   REGULAR COURSE.
92=SHORTCUT (ONE)
93=SHORTCUT (TWO)
94=SHORTCUT (THREE)
95=SHORTCUT (FOUR)
96=SHORTCUT (FIVE)
97=MOVE 4 SPACES FORWARD
98=COLORED SPACE
99=MOVE 15 SPACES FORWARD
100=COLORED SPACE
101=SALT LAKE CITY (CITY)
102=COLORED SPACE
103=SPONSOR PAYS $25,000
```

FIG. 2

```
104=COLORED SPACE
105=COLORED SPACE
106=AUCTION,(ONE CAR)
107=COLORED SPACE
108=MOVE TO NEXT BORDER
    AHEAD
109=COLORED SPACE
110=MINNEAPOLIS (CITY)
111=COLORED SPACE
112=COLORED SPACE
113=COLORED SPACE
114=CHICAGO (CITY)
115=SPONSOR PAYS $30,000
116=DETROIT,MANUFACTURER
    CAR GROUP # 8,USA CARS
    CADILLAC,CORVETTE
    CAR GROUP # 15, USA
    CARS:VECTOR NO.1+2
117=BORDER
118=TORONTO (CITY)
119=COLORED SPACE
120=COLORED SPACE
121=COLORED SPACE
122=PHOENIX (CITY)
123=BORDER
124=COLORED SPACE
125=COLORED SPACE
126=COLORED SPACE
127=AUCTION, (ONE CAR)
128=COLORED SPACE
129=COLORED SPACE
130=GUADALAJARA (CITY)
131=MOVE TO NEXT BORDER AHEAD
132=MEXICO CITY,IMPORT CITY
    CAR GROUP # 10, SWISS
    CARS:MONTEVERDI NO.1+2
133=COLORED SPACE
134=CRASH
135=COLORED SPACE
136=MONTERREY (CITY)
137=BORDER
138=COLORED SPACE
139=MOVE 8 SPACES FORWARD
140=HOUSTON,IMPORT CITY,CAR
    GROUP # 14,ITALIAN CARS
    FERRARI,LAMBORGHINI
141=COLORED SPACE
142=DALLAS (CITY)
143=COLORED SPACE
144=MOVE 7 SPACES FORWARD
145=COLORED SPACE
146=MOVE 7 SPACES FORWARD
147=DENVER (CITY)
148=COLORED SPACE
149=COLORED SPACE
150=MOVE 3 SPACES FORWARD
151=KANSAS CITY (CITY)
152=COLORED SPACE
153=ST. LOUIS (CITY)
154="SCORE-LINE",RECEIVE
    POINTS FOR EACH CAR
155=INDIANAPOLIS (CITY),
    RACE FOR POINTS
```

FIG. 3

FEELING CONFIDENT, YOU THROW A VICTORY PARTY IN ST. LOUIS, INVITING THE OTHER PLAYERS, EACH OF WHOM HAS TO PAY HIS OWN TRANSPORTATION COSTS OF $500 PER CAR.
GO BANKRUPT IF YOU CAN NOT PAY $10,00 FOR EACH COMPETITOR ACCEPTING.

FIG. 4

SELECT A NUMBER CARD AND RECEIVE A NEW CAR FREE, IF AVAILABLE, CORRESPONDING TO THE GROUP NUMBER.
NUMBER CARDS 15-18 ARE EQUAL TO GROUP NUMBER 15.
IF UNAVAILABLE, RECIVE CASH EQUAL TO THE CAR'S VALUE.

FIG. 5

FLY FORWARD TO LAS VEGAS: GAMBLE FOR POINTS IF YOU LIKE, COLLECT POINTS IF YOU PASS THE "SCORE-LINE" ON YOUR OUTGOING FLIGHT AND PERFORM YOUR SPECIAL TALENT LIKE TELLING JOKES, SINGING, DANCING, CHARADES, ETC.
STAY WHERE YOU ARE IF YOU DO NOT WANT TO PERFORM.

FIG. 6

RECEIVE $5,000 MULTIPLIED BY THE NUMBER ON THE NUMBER CARD YOU SELECT FOR ROYALTIES DUE YOU BY A HOLLYWOOD FILM STUDIO IN MAKING A MOVIE OF YOUR CAREER.
RECEIVE DOUBLE THE AMOUNT BY DOING A SCENE FROM A DIFFERENT MOVIE AND CONVINCING THE OTHER PLAYERS YOU SHOULD BE THE STAR.

FIG. 7

THE LAST PLAYER (OR SEVERAL LAST PLAYERS WITH THE SAME POINTS) COLLECT 10 POINTS TO CATH UP WITH THE LEADER, OR THE SAME NUMBER OF POINTS IF THE LEADER HAS FEWER THAN 10 POINTS.

FIG. 8

FLY FORWARD TO MEXICO CITY TO JOIN THE FAMILY IN CELEBRATING YOUR MOTHER-IN-LAW'S BIRTHDAY, PURCHASE A CAR IF AVAILABLE AND COLLECT POINTS IF YOU PASS THE "SCORE-LINE" ON YOUR OUTGOING FLIGHT.

FIG. 9

DOUBLE THE POINTS YOU SCORE THIS ROUND WHEN YOU PASS THE "SCORE-LINE" IF YOU OWN AT LEAST ONE RACING-TEAM.

FIG. 10

INVITE ALL COMPETITORS TO FLY FORWARD TO A VICTORY PARTY IN GUADALAJARA, EACH COLLECTING POINTS IN PASSING THE "SCORE-LINE" ON THE OUTGOING FLIGHT.
THE PARTY IS A COMPLETE SUCCESS AND COSTS YOU $50,000. IF YOU HAVE LESS THAN $50,000, KEEP YOUR MONEY BUT LOSE A CAR OF YOUR CHOICE.

FIG. 11

FLY FORWARD TO NEW YORK TO PARTICIPATE IN THE "JODELN" OR "CHICKENDANCE" CONTEST AT THE "OKTOBERFEST", PURCHASE A CAR IF AVAILABLE AND COLLECT POINTS IF YOU PASS THE "SCORE-LINE" ON YOUR OUTGOING FLIGHT.
ADVANCE TO CALGARY IF YOU GIVE A GOOD PERFORMANCE.

FIG. 12

SINCE YOU HAVE AGREED TO DONATE YOUR BODY TO MEDICAL SCIENCE AFTER YOUR DEATH, FLY FORWARD TO THE HOUSTON MEDICAL CENTER TO RECEIVE $2,000, COLLECT POINTS IF YOU PAS THE "SCORE-LINE" ON YOUR OUTGOING FLIGHT AND PURCHASE A CAR IF AVAILABLE.

FIG. 13

SINCE THE RACE IS BECOMING TO LONELY, FLY FORWARD TO ANY SPACE OF YOUR CHOICE OCCUPIED BY ANOTHER PLAYER AND PERFORM THE DUTY IMPOSED BY SUCH SPACE.
DO NOT COTTECT ANY POINTS IF YOU PASS THE "SCORE-LINE".

FIG. 14

PLAY THIS CARD AND FLY FORWARD TO DETROIT TO PURCHASE THE CAR YOU ORDERED IF IT IS AVAILABLE OR BECOMES AVAILABLE, AND COLLECT POINTS IF YOU PASS THE "SCORE-LINE" ON YOUR OUTGOING FLIGHT AND SUCH FLIGHT IS THE SHORTEST ROUTE POSSIBLE.

FIG. 15

FLY FORWARD TO LOS ANGELES, RECEIVE $100,000 FOR DOING A MOVIE-STUNT SCENE, PURCHASE A CAR IF AVAILABLE AND COLLECT POINTS IF YOU PASS THE "SCORE-LINE" ON YOUR OUTGOING FLIGHT.

FIG. 16

FLY FORWARD TO WASHINGTON, D.C. FOR A PERSONAL APPEARANCE AT THE WHITE HOUSE AND COLLECT POINTS IF YOU PASS THE "SCORE-LINE" ON YOUR OUTGOING FLIGHT.

FIG. 17

FLY FORWARD TO A CITY OF YOUR CHOICE, PURCHASE A CAR IF AVAILABLE AND COLLECT POINTS IF YOU PASS THE "SCORE-LINE" ON YOUR OUTGOING FLIGHT.
STAY WHERE YOU ARE IF YOU REFUSE TO PAY TRANSPORTATION COSTS OF $8,000 PER CAR.

FIG. 18

BAD STREET!
IF YOU SELECTED A NUMBER CARD FROM 1-9, GO BACK ONE SPACE AND, IF YOU SELECTED A NUMBER CARD FROM 10-18, GO BACK TWO SPACES. NO FURTHER ACTION OR LOSSES ON THE SPACE TO WHICH YOU RETURN.

FIG. 19

FLY FORWARD TO THE CITY WHERE YOU PRESENTLY LIVE, OR NEAREST IDENTIFIABLE CITY: REST ONE TURN WHILE YOU REPLACE THE CREDIT CARDS, BIRTH CERTIFICATE AND PASSPORT YOU LOST; PURCHASE A CAR IF AVAILABLE; AND COLLECT POINTS IF YOU PASS THE "SCORE-LINE" ON YOUR OUTGOING FLIGHT.

FIG. 20

SING A SONG AND RECEIVE $10,000 IF THE OTHER PLAYERS JUDGE YOU HAVE THE TALENT TO MAKE A HIT RECORD.

FIG. 21

FLY FORWARD TO THE CITY WHERE YOU PRESENTLY LIVE, OR NEAREST IDENTIFIABLE CITY, TO JOIN YOUR FAMILY AND FRIENDS AND RECEIVE $ 10,000 THEY COLLECTED FOR YOUR SUPPORT, PURCHASE A CAR IF AVAILABLE AND COLLECT POINTS IF YOU PASS THE "SCORE-LINE" ON YOUR OUTGOING FLIGHT.

FIG. 22

FLY FORWARD TO A CITY OF YOUR CHOICE, PURCHASE A CAR IF AVAILABLE AND COLLECT POINTS IF YOU PASS THE "SCORE-LINE" ON YOUR OUTGOING FLIGHT.
STAY WHERE YOU ARE IF YOU CAN NOT PAY $10,000 FOR TRAVEL COSTS.

FIG. 23

STOP TO MAKE AN IMPORTANT TELEPHONE CALL IF YOU HAVE ANY CHANGE, THEN CONTINUE WITH THE RACE; OTHERWISE GO BACK ONE SPACE TO GET CHANGE ONLY.

FIG. 24

FLY FORWARD TO THE CITY WHERE YOU PRESENTLY LIVE, OR NEAREST IDENTIFIABLE CITY, FOR A CELEBRATION IN YOUR HONOR, PURCHASE A CAR IF AVAILABLE AND COLLECT POINTS IF YOU PASS THE "SCORE-LINE" ON YOUR OUTGOING FLIGHT.

FIG. 25

SETTLE YOUR LIBEL SUIT AND RECEIVE $10,000 FOR THE SCANDALOUS STORY A TABLOID PRINTED ABOUT YOU.

FIG. 26

LOSE YOUR LEAST EXPENSIVE CAR AND PAY $80,000 FOR LIABILITY PAYMENTS FOR BEING AT FAULT IN TOTALLING YOUR CAR.
LOSE ANOTHER CAR OF YOUR CHOICE AND SETTLE THE LIABILITY CLAIMS OR GO BANKRUPT, IF YOU CAN NOT AFFORD TO PAY.

FIG. 27

GO BACK TO THE LAST TOWN YOU PASSED AND LIKED, TO SPEND THE NIGHT, AND PURCHASE A CAR IF AVAILABLE.

FIG. 28

ADVANCE ON THE "SCOREBOARD" THE PEG(S) OF THE LAST PLAYER (OR SEVERAL LAST PLAYERS HAVING THE SAME SCORE) TO CATCH UP WITH THE LEADER.

FIG. 29

ALTERNATIVE CARD!
SNEEZE 10 TIMES IN ALLERGIC RESPONSE TO FLOWERS, OR GO BACK ONE SPACE TO SEE A DOCTOR AND PAY $100, ONLY.

FIG. 30

PAY $1,100 TRANSPORTATION COSTS PER CAR, FLY FORWARD TO THE NEXT BORDER AND COLLECT POINTS IF YOU PASS THE "SCORE-LINE" ON YOUR OUTGOING FLIGHT.
STAY WHERE YOU ARE IF YOU REFUSE TO PAY.

FIG. 31

AUCTION!
THE AUCTIONEER WILL DETERMINE THE ORDER IN WHICH 3 CAR WILL BE AUCTIONED OFF IF AVAILABLE.

FIG. 32

THE RACE COMMITTEE DEDUCTED 2 POINTS (NONE IF THE COMPETITOR HAD ONLY 1 POINT) IN ALLOWING YOUR PROTEST AGAINST SUCH COMPETITOR'S TAKING AN ILLEGAL SHORTCUT.

FIG. 33

LICENSE FEE!
PAY $75,000, OR LOSE TWO CARS OF YOUR CHOICE (OR YOUR ONLY CAR), OR GO BANKRUPT.

FIG. 34

CHOOSE ONE OF YOUR FINANCED CARS FOR REPOSSESSION FOR FAILURE TO MAKE MONTHLY PAYMENTS.
DISREGARD IF NONE OF YOUR CARS IS FINANCED.

FIG. 35

EACH COMPETITOR WILL PLAY TWO TURNS FOR THE PLAYER SEATED ON HIS IMMEDIATE RIGHT AND MAKE FINAL DECISIONS, INCLUDING ANY DUTY CARD HELD BY SUCH PLAYER.

FIG. 36

ALTERNATIVE CARD!
PERFORM 5 SITUPS OR LOSE ONE TURN TO MASSAGE ANOTHER PLAYER.

FIG. 37

SING A SONG ABOUT THE CITY YOU HOPE TO REACH.
SING AS LOUD AS YOU CAN!
COLLECT $5,000 IF YOU LAND UPON OR PASS SUCH CITY WHILE ADVANCING.

FIG. 38

EACH COMPETITOR WILL PLAY TWO TURNS FOR THE PLAYER SEATED ON HIS IMMEDIATE LEFT AND MAKE FINAL DECISIONS, INCLUDING ANY DUTY CARD HELD BY SUCH PLAYER.

FIG. 39

YOUR PROTEST AGAINST THE LEADER(S) IS ALLOWED AND 5 POINTS IS DEDUCTED FROM EACH OF THE LEADERS HAVING AT LEAST 5 POINTS.
THIS PENALTY DOES NOT APPLY AGAINST YOU IF YOU ARE THE LEADER OR ONE OF THE LEADERS.

FIG. 40

RECEIVE $80,000 FOR SUCCESSFULLY NEGOTIATING A HIGHER BUDGET TO BENEFIT A SPONSOR BY MORE EXPOSURE AND ADVERTISING.

FIG. 41

YOU MUST PAY $15,000 TRAVEL EXPENSES OR STAY WHERE YOU ARE, TO FLY FORWARD TO THE NEAREST AUCTION SPACE TO PURCHASE ANY CAR FOR A MINIMUM $200 BID AND TO COLLECT POINTS IF YOU PASS THE "SCORE-LINE" ON YOUR OUTGOING FLIGHT.

FIG. 42

THIS CARD IS NOT EFFECTIVE AGAINST YOU.
PLAY THIS CARD AT ANY TIME TO SLOW DOWN THE LEADER FOR TWO TURNS BECAUSE THE LEADER FILLED HIS FUEL TANKS WITH CONTAMINATED FUEL.

FIG. 43

AS AN EXPERIENCED DRIVER AND FORMER "WORLD CHAMPION" IN "FORMULA 1" RACING, YOUR HANDICAP IS ONLY TO RETURN TO "START", (SPACE 1).

FIG. 44

COLLECT UP TO THREE ADDITIONAL POINTS BY PAYING $20,000 CASH PER POINT.

FIG. 45

PAY AN INTEREST SURCHARGE OF $4,000 FOR EACH CAR FINANCED IN GROUPS 1-8 AND $15,000 FOR EACH CAR FINANCED IN GROUPS 9-15. IF YOU CAN NOT PAY, EITHER LOSE TWO CARS, OR LOSE ALL YOUR REMAINING CASH OR DECLARE BANKRUPTCY.

FIG. 46

YOU RECEIVE NO MONEY IN THE AUCTIONING OFF TO THE HIGHEST BIDDER ONE OF YOUR CARS.

FIG. 47

UPON PICKING THIS CARD, THE LEADER WILL LOSE A CAR THAT YOU CHOOSE, OR EACH OF THE CO-LEADERS WILL LOSE A CAR THAT YOU CHOOSE.
THIS CARD DOES NOT APPLY TO YOU IF YOU ARE THE LEADER OR A CO-LEADER.
THIS CARD DOES NOT APPLY IF PLAYERS HAVE NOT YET SCORED ANY POINTS.

FIG. 48

IF YOU HAVE AT LEAST TWO CARS, SELL AND RECEIVE THE FULL VALUE OF ONE OF YOUR CARS, WHETHER FINANCED OR NOT.

FIG. 49

YOU MUST PAY $10,000 TRAVEL EXPENSES TO FLY FORWARD TO THE "SCORE-LINE" TO COLLECT YOUR POINTS OR STAY WHERE YOU ARE.

FIG. 50

AS A RESULT OF A PROTEST ALLOWED AGAINST A COMPETITOR YOU NAMED, HE LOSES TWO POINTS IF HE HAS THEM AND MUST PAY DIRECTLY TO YOU $10,000; OR IF HE CAN NOT PAY YOU, A CAR OF HIS CHOICE MUST BE TRANSFERRED TO YOU ALONG WITH ITS FINANCED DEBT.

FIG. 51

FLY FORWARD TO BOSTON AT ITS INVITATION, PURCHASE A CAR IF AVAILABLE AND COLLECT POINTS IF YOU PASS THE "SCORE-LINE" ON YOUR OUTGOING FLIGHT.
IF YOU HAVE TO CROSS A BORDER TO GET TO BOSTON, PAY $400 TO REPLACE YOUR LOST PASSPORT OR STAY WHERE YOU ARE.

FIG. 52

FLY FORWARD TO NASSAU AND THE BAHAMAS TO WORK ON YOUR TAN AND COLLECT POINTS IF YOU PASS THE "SCORE-LINE" ON YOUR OUTGOING FLIGHT.

FIG. 53

REST FOR TWO TURNS IF YOU DO NOT PAY THE $20,000 FINE IMPOSED BY THE RACE COMMITTEE FOR RECKLESS DRIVING.

FIG. 54

FLY FORWARD TO PHOENIX AND COLLECT POINTS IF YOU PASS THE "SCORE-LINE" ON YOUR OUTGOING FLIGHT.
STAY WHERE YOU ARE IF YOU CAN NOT PAY TRANSPORTATION COSTS OF $6,000 PER CAR.

FIG. 55

PAY ADDITIONAL FINANCE CHARGES OF $5,000 PER FINANCED CAR MULTIPLIED BY THE NUMBER CARD YOU SELECTED.
IF YOU CAN NOT PAY, LOSE YOUR MOST EXPENSIVE CAR OR GO BANKRUPT.

FIG. 56

A TOW TRUCK CHARGES YOU $200 TO PULL YOU BACK ON THE ROAD WHEN YOU GOT STUCK IN THE MUD OFF THE ROAD.
REPAIRS COST YOU AN ADDITIONAL $8,000 IF YOUR SELECTED NUMBER CARD WAS 10-18.
CONTINUE THE RACE IF YOU CAN NOT PAY, BUT LOSE A CAR OF YOUR CHOICE.

FIG. 57

ALTERNATIVE CARD!
ACCOMPANY A SONG ON THE RADIO, ADVANCE THREE SPACES AND PERFORM ANY DUTY IMPOSED ON THE SPACE UPON WHICH YOU LAND.
STAY WHERE YOU ARE IF YOU DO NOT LIKE TO SING.

FIG. 58

HOLD THIS CARD AND TENDER IT WHEN YOU WANT TO HAVE A SPONSOR REDUCE UP TO $10,000 OF YOUR DEBTS.

FIG. 59

A SPONSOR WILL PAY OFF THE DEBT FINANCED ON ONE OF THE CARS OF YOUR CHOICE.
RETURN THIS CARD IMMEDIATELY TO THE DECK IF NONE OF YOUR CARS IS FINANCED.

FIG. 60

FLY FORWARD TO KANSAS CITY AND COLLECT POINTS IF YOU PASS THE "SCORE-LINE" ON YOUR OUTGOING FLIGHT.
STAY WHERE YOU ARE IF YOU CAN NOT AFFORD TO PAY TRANSPORTATION COSTS OF $5,000 PER CAR.

FIG. 61

FLY FORWARD TO DENVER AND COLLECT POINTS IF YOU PASS THE "SCORE-LINE" ON YOUR OUTGOING FLIGHT.

FIG. 62

ALL PLAYERS (YOURSELF INCLUDED), 10 SPACES IN ADVANCE OF OR BEHIND YOU, MUST WAIT OUT ONE TURN IN A HEAVY STORM FOR WEATHER CONDITIONS TO IMPROVE.
THIS PENALTY DOES NOT APPLY TO OTHER PLAYERS SUBSEQUENTLY DRIVING OR FLYING OVER THE AREA.

FIG. 63

RECEIVE $4,000 IF THE OTHER PLAYERS AGREE THAT YOU DID A GOOD COMMERCIAL.

FIG. 64

LOSE TWO CARS OF YOUR CHOICE OR GO BANKRUPT, IF YOU CAN NOT PAY THE $100,000 FINE IMPOSED IN THE PROTEST ALLOWED AGAINST YOU.

FIG. 65

IF YOU OWN AT LEAST ONE "RACING TEAM", ADVANCE DOUBLE THE NUMBER OF SPACES INDICATED BY YOUR SELECTED NUMBER CARD AND PERFORM THE DUTY IMPOSED ON THE SPACE UPON WHICH YOU LAND.

FIG. 66

GO BACK TWO SPACES FOR SLOW DRIVING, IN YOUR DAY-DREAMING ABOUT VICTORY IN THE RACE. NO FURTHER ACTION OR LOSS ON THE SPACE TO WHICH YOU RETURN.

FIG. 67

LOSE ONE CAR OF YOUR CHOICE IF YOU CAN NOT PAY $30,000 TO FLY IN SPARE REPAIR PARTS.

FIG. 68

LUCK STRIKES!
RECEIVE A $10,000 BONUS FOR EACH CAR NOT FINANCED.

FIG. 69

REST ONE TURN IF YOU DO NOT PAY THE $10,000 FINE THE RACE COMMITTEE IMPOSED AGAINST YOU FOR DANGEROUS DRIVING.

FIG. 70

PAY $5,000 IF YOU DO REFUSE TO DESCRIBE THE EMBARRASSING PHOTO A TABLOID SNAPPED OF YOU.

FIG. 71

PAY THE $5,000 FINE THE RACE COMMITTEE IMPOSED IN ALLOWING A PROTEST AGAINST YOU FOR NOT LETTING A FASTER COMPETITOR PASS OR REST ONE TURN.

FIG. 72

ADVANCE 3 SPACES BECAUSE OF STRONGER ENGINE PERFORMANCE, PURCHASE A CAR IF AVAILABLE AND PERFORM THE DUTY IMPOSED ON THE SPACE UPON WHICH YOU LAND.

FIG. 73

EVERY PLAYER HAVING MORE THAN $400,000 CASH PAYS $200,000 INCOME TAX.

FIG. 74

LOSE ONE CAR OF YOUR CHOICE OR GO BANKRUPT, IF YOU CAN NOT PAY $3,000 FOR EACH FINANCED CAR BECAUSE OF REFINANCING FOR YOUR GREATER RISK CATEGORY.

FIG. 75

DISASTER STRIKES IF YOU ARE IN DEBT!
SELECT A NUMBER CARD AND MULTIPLY THE SELECTED NUMBER BY $5.000.
LOSE A CAR OF YOUR CHOICE OR GO BANKRUPT, IF YOU CAN NOT PAY.

FIG. 76

COLLECT FOUR EXTRA POINTS FOR BREAKING THE ROUND RECORD IN YOUR RACING CLASS.

FIG. 77

GO BACK TO A CITY WITHIN THE NUMBER OF SPACES YOU JUST ADVANCED, PAY $2,000 TO HAVE YOUR CAR REPAIRED AND PURCHASE A CAR IF AVAILABLE. PAY $10,000 TO FLY IN A SERVICE TEAM IF THERE IS NO SUCH CITY.
STAY WHERE YOU ARE AND LOSE A CAR OF YOUR CHOICE IF YOU CAN NOT PAY.

FIG. 78

PLAY THIS CARD WHEN YOU LAND ON SALT LAKE CITY TO COLLECT BONUS POINTS CORRESPONDING TO THE NUMBER CARD YOU SELECT FOR BREAKING THE WORLD SPEED RECORD ON THE GREAT SALT LAKE.

FIG. 79

AUCTION!
THE AUCTIONEER WILL DETERMINE THE ORDER IN WHICH 2 CARS, IF AVAILABLE , ARE AUCTIONED OFF TO THE HIGHEST BIDDERS.

FIG. 80

FLY FORWARD TO ANY SPACE IN MEXICO FOR A VACATION,PURCHASE A CAR IF AVAILABLE AND COLLECT POINTS IF YOU PASS THE " SCORE-LINE" ON YOUR OUTGOING FLIGHT. A COMPETITOR CAN SIMILARLY PURCHASE A CAR IF AVAILABLE AND COLLECT POINTS IF INVITED AS YOUR GUEST, BUT YOU HAVE FIRST-REFUSAL RIGHTS IF ONLY ONE CAR IS AVAILABLE.

FIG. 81

PHYSICIAN ADVISES REST.
ETHER STAY WHERE YOU ARE
OR GO BACK, AT YOUR CHOICE,
UP TO 10 SPACES BUT
DISREGARD ANY DUTY IMPOSED
UPON THE SPACE TO WHICH
YOU RETURN.

FIG. 82

FLY FORWARD TO SAN FRANCISCO,
PURCHASE A CAR IF AVAILABLE
AND COLLECT POINTS IF YOU
PASS THE "SCORE-LINE" ON
YOUR OUTGOING FLIGHT.

FIG. 83

LOSE YOUR MOST EXPENSIVE
CAR THAT WAS TOTALLED IN A
CRASH.

FIG. 84

LOSE TWO CARS OF YOUR CHOICE
OR GO BANKRUPT, IF YOU CAN
NOT PAY HIGH-RISK INTEREST
CHARGES OF $10,000 FOR
EACH FINANCED CAR WHOSE
CREDIT LIMIT IS BELOW
$90,000 AND $20,000 FOR
EACH FINANCED CAR WHOSE
CREDIT LIMIT IS ABOVE $90,000.

FIG. 85

FLY FORWARD TO VANCOUVER FOR
A WEEKEND SKIING AND SAILING
VACATION, PAY $4,000 FOR
YOUR EXPENSES, PURCHASE A CAR
IF AVAILABLE AND COLLECT
POINTS IF YOU PASS THE
"SCORE-LINE" ON YOUR OUTGOING
FLIGHT.
STAY WHERE YOU ARE IF YOU
CAN NOT AFFORD THE EXPENSE.

FIG. 86

RECEIVE FREE ANY CAR
AVAILABLE THAT IS VALUED AT
LESS THAN $100,000 WHEN
YOU LAND IN SAN DIEGO OR
IF NOT AVAILABLE, KEEP THIS
CARD AND PLAY IT WHEN SUCH
CAR BECOMES AVAILABLE.

FIG. 87

SEE YOUR FAVORITE MOVIE IN A CITY IF WITHIN YOUR NEXT ADVANCE, OTHERWISE MOVE BACK TO THE NEAREST CITY.
IN EITHER EVENT, REST ONE TURN, SEE THE MOVIE AND PURCHASE A CAR IF AVAILABLE.

FIG. 88

KEEP AND PLAY THIS CARD TO RECEIVE FREE ANY AVAILABLE CAR REGARDLESS OF ITS EXPENSE. THE HIGHER NUMBER CARD PREVAILS IF ANOTHER PLAYER HOLDS A CARD SIMILAR IN EFFECT.

FIG. 89

FLY FORWARD TO MIAMI, PURCHASE A CAR IF AVAILABLE AND COLLECT POINTS IF YOU PASS THE "SCORE-LINE" ON YOUR OUTGOING FLIGHT; IF THERE IS NO CAR AVAILABLE, TAKE A CRUISE TO NASSAU AND THE BAHAMAS.

FIG. 90

LOSE YOUR MOST EXPENSIVE CAR IF YOU CAN NOT PAY $5,000 IMPORT DUTY FOR EACH FOREIGN CAR.
CARS MANUFACTURED IN GROUP NOS. :
6
8
15

ARE DUTY FREE.

FIG. 91

ADVANCE, ON THE "SCOREBOARD", YOUR PEG TO THE SAME POINT SCORE OCCUPIED DY THE LEADER.

FIG. 92

RECEIVE $50,000 IF THE OTHER PLAYERS LIKE YOUR "CENTERFOLD" POSE FOR A CAR MAGAZINE.

FIG. 93

SELL YOUR MOST EXPENSIVE CAR FOR $10,000. IF YOU HAVE ONLY ONE CAR, TRADE IT DEBT-FREE FOR THE CHEAPEST CAR AVAILABLE.

FIG. 94

PAY $90,000 BACK TAXES AND PENALTIES AS A RESULT OF AN IRS AUDIT OF YOUR FEDERAL TAX RETURN, OR PAY $45,000 AND LOSE ONE CAR OF YOUR CHOICE, OR LOSE TWO CARS OF YOUR CHOICE OR GO BANKRUPT.

FIG. 95

UPON LANDING ON OR ADVANCING PAST LAS VEGAS AT YOUR NEXT OPPORTUNITY, TAKE THE SHORTCUT SOUTH OF LAS VEGAS BY SINGING A X-MAS SONG.

FIG. 96

PLAY THIS CARD AT YOUR OPTION TO RECEIVE FREE ANY CAR OF YOUR CHOICE AT CITY PURCHASES OR AUCTION. THE HIGHER NUMBER CARD PREVAILS IF ANOTHER PLAYER IS HOLDING A CARD OF SIMILAR EFFECT.

FIG. 97

LOSE TWO CARS OF YOUR CHOICE OR GO BANKRUPT, IF YOU DO NOT REFUND YOUR SPONSOR $150,000.

FIG. 98

ADVANCE 30 SPACES, COLLECT POINTS IF YOU PASS THE "SCORE-LINE" AND PERFORM THE DUTY IMPOSED ON THE SPACE TO WHICH YOU ADVANCE, IF YOU OWN A CAR MADE IN DETROIT OR MONTREAL.

FIG. 99

ADVANCE THE SAME NUMBER OF SPACES YOU ALREADY ADVANCED AND WITH NO DUTY IMPOSED IF YOU CORRECTLY CALCULATE THE PRODUCT OF THE NUMBER CARD YOU SELECTED
MULTIPLIED BY
27 FOR ADULT PLAYERS
AND
9 FOR CHILDREN

FIG. 100

LIFT YOUR CAR BY HAND TO CHANGE A " BLOWN-OUT" TIRE.
LOSE A TURN IF YOU ARE UNABLE TO DEMONSTRATE YOUR STRENGTH BY HOLDING OUTSTRETCHED FOR ONE MINUTE AT LEAST A ONE-POUND OBJECT.

FIG. 101

WITHIN A MINUTE, MAKE UP A POEM ABOUT ONE OF THE TWO CITIES IN ADVANCE OF YOU. YOU RECEIVE $5,000 IF THE POEM IS PRINTED IN THE LOCAL NEWSPAPER WHEN, IN YOUR ADVANCE, YOU LAND ON THAT CITY OR PASS BY.

FIG. 102

CHECKPOINT STOP!
COLLECT TWO EXTRA POINTS.

FIG. 103

YOU HAVE EXCELLENT REACTIONS AND THEREFORE CAN MANAGE TO AVOID COLLISIONS.
KEEP AND PLAY THIS CARD TO AVOID LOSING A CAR WHEN LANDING UPON A CRASH SPACE.

FIG. 104

PAY A $50,000 REFINANCE CHARGE IF YOUR DEBTS EXCEED $100,000. LOSE TWO CARS OF YOUR CHOICE OR FIVE POINTS, IF YOU CAN NOT PAY AND YOU HAVE AT LEAST FIVE POINTS.
GO BANKRUPT IF YOU CAN NOT PAY AND HAVE FEWER THAN FIVE POINTS.

FIG. 105

YOUR PROTEST AGAINST THE LEADER IS ALLOWED AND THREE POINTS ARE DEDUCTED,UNLESS YOU ARE THE LEADER.

FIG. 106

FLY FORWARD TO DALLAS, RECEIVE $150,000 FROM A NEW SPONSOR AND COLLECT POINTS IF YOU PASS THE "SCORE-LINE" ON YOUR OUTGOING FLIGHT.

FIG. 107

PLAY THIS CARD IMMEDIATELY TO HAVE A SPONSOR DISCHARGE UP TO $100,000 OF YOUR DEBTS.

FIG. 108

FLY FORWARD TO INDIANAPOLIS TO PARTICIPATE IN A "SHOW-OFF" ROUND, RECEIVE $250,000 FROM YOUR SPONSOR, RACE FOR POINTS AND COLLECT POINTS IF YOU PASS THE "SCORE-LINE" ON YOUR OUTGOING FLIGHT.

FIG. 109

COLLECT AN ADDITIONAL TWO POINTS DUE TO AN INCORRECT ACCOUNTING ON THE SCOREBOARD.

FIG. 110

FLY FORWARD TO ANY CANADIAN CITY OF YOUR CHOICE FOR A FISHING TRIP, PURCHASE A CAR IF AVAILABLE AND COLLECT POINTS IF YOU PASS THE "SCORE-LINE" ON YOUR OUTGOING FLIGHT.

FIG. 111

FOR EACH TIME YOU CATCH-UP WITH OR PASS A COMPETITOR IN YOUR ADVANCE OR SUCCESSIVE ADVANCES TO THE "SCORE-LINE", COLLECT TWO BONUS POINTS. RETURN THIS CARD TO THE DECK WHEN YOU LAND ON OR PASS THE "SCORE-LINE".

FIG. 112

MAKE YOUR FUNNIEST FACE FOR A NEWSPAPER PHOTOGRAPHER TO TAKE YOUR PICTURE AND RECEIVE $1,000.

FIG. 113

SUNGLASSES NEEDED!
FIND THEM IN ONE MINUTE OR RETURN TO THE LAST CITY YOU PASSED TO PURCHASE THEM FOR $100.
NO FURTHER ACTION IS ALLOWED IN THAT CITY.

FIG. 114

YOU DRIVE AT TOP SPEED IN AIDING THE POLICE IN A SUCCESSFUL PURSUIT, ADVANCE 10 SPACES, PURCHASE A CAR IF AVAILABLE AND PERFORM ANY DUTY IMPOSED ON THE SPACE UPON WHICH YOU LAND.

FIG. 115

COLLECT TWO BONUS POINTS EACH TIME YOU CATCH-UP WITH OR PASS A COMPETITOR IN THIS ADVANCE AND THE NEXT ADVANCE AND WHETHER YOU DRIVE OR FLY.

FIG. 116

YOU ARE RUNNING SHORT ON GAS. REFUEL BY MOVING BACK TO ONE OF TEN SPACES YOU CHOOSE AND PAY $100 PER CAR.
NO FURTHER ACTION IS ALLOWED ON THE SPACE YOU CHOOSE.

FIG. 117

LOSE ONE CAR OF YOUR CHOICE OR FOUR POINTS, IF YOU CAN NOT PAY THE $35,000 FINE LEVIED IN THE PROTEST ALLOWED AGAINST YOU.

FIG. 118

PAY THE $80,000 SURCHARGE FOR HIGH-RISK INSURANCE. TO SECURE PAYMENT IF YOU CAN NOT PAY, CHOOSE TWO CARS OF YOUR CHOICE AND SURRENDER THEIR TITLES TO THE SECRETARY TO HOLD.
SUCH TWO CARS CAN NOT FURTHER PARTICIPATE OR COLLECT POINTS UNTIL YOU PAY THE SURCHARGE. GO BANKRUPT IF YOU OWN ONLY TWO CARS.

FIG. 119

AS A POTENTIAL RACE WINNER, GIVE YOUR BEST SMILE SO THE PRESS CAN SNAP YOUR PICTURE.

FIG. 120

THE POLICE STOP YOU FOR SPEEDING. YOUR EXPLANATION THAT YOU ARE RACING AGGRAVATES THE MATTER.
LOSE TIME BY RESTING ONE TURN IF YOU CAN NOT PAY THE $5,000 SPEEDING FINE.

FIG. 121

YOU ARE RACING TOO SLOW!
LIGHTEN THE LOAD BY THROWING OUT TOOLS, SEATS, REMOVING PASSENGERS, TO GAIN SPEED.
AT YOUR NEXT TURN, SELECT TWO NUMBER CARDS FOR SUCCESSIVE ADVANCES.PERFORM THE DUTIES IMPOSED ON THE SPACES YOU SUCCESSIVELY LAND UPON.
PURCHASE A CAR IF AVAILABLE.

FIG. 122

RECEIVE $10,000 FROM A MANUFACTURE FOR A LIKENESS OF YOURSELF WHICH APPEARED ON ITS BOX OF CEREAL.

FIG. 123

RETURN TO "START" AS YOU ARE COMPLETELY LOST. DO NOT PASS THE "SCORE-LINE".

FIG. 124

KEEP THIS CARD AND PLAY IT TO AUCTION OFF A CAR OF YOUR CHOICE AT A FIXED MINIMUM PRICE TO GET CASH. THE HIGHEST BIDDER TAKES TITLE ALONG WITH ANY FINANCED DEBT AND PAYS YOU DIRECTLY.

FIG. 125

ALTERNATIVE CARD! PAY $15,000 TO REPAIR FIRE DAMAGE TO THE ENGINE OF ONE OF YOUR CARS AND MOVE BACK 5 SPACES FOR REPAIR TIME LOST OR LOSE A CAR OF YOUR CHOICE AND KEEP RACING. NO FURTHER ACTION OR LOSSES ON THE SPACE YOU LAND UPON IF YOU MOVE BACK.

FIG. 126

RECEIVE $8,000 FOR A MAGAZINE INTERVIEW PROVIDED YOU ANSWER A QUESTION POSED BY ANOTHER PLAYER.

FIG. 127

YOUR POINTS WERE RECORDED WRONG ON THE "SCOREBOARD". COLLECT FOUR EXTRA POINTS WHEN NEXT YOU LAND UPON OR PASS THE "SCORE-LINE".

FIG. 128

FLY FORWARD TO LAS VEGAS, WIN FREE A CAR OF YOUR CHOICE IF AVAILABLE, GAMBLE FOR POINTS AND COLLECT POINTS IF YOU PASS THE "SCORE-LINE" ON YOUR OUTGOING FLIGHT.

FIG. 129

KEEP THIS CAR AND PLAY IT WHEN THE OPPORTUNITY ARISES TO PURCHASE A CAR, INCLUDING AT AUCTION. A SPONSOR WILL CONTRIBUTE UP TO $50,000 TOWARDS YOUR PURCHASE.

FIG. 130

KEEP THIS CARD AND PLAY IT ONLY ONE TIME TO PREVENT THE LEADER FROM WINNING THE RACE BY PAYING $20,000 CASH PER POINT TO REMOVE POINTS FROM THE LEADER. OTHER PLAYERS CAN CONTRIBUTE CASH. THIS CARD CAN NOT BE PLAYED AGAINST YOU.

FIG. 131

IMMEDIATELY PLAY THIS CARD TO RESHUFFLE THE DECK. (THIS CARD SHOULD BE THE LAST CARD IN THE DECK AT THE BEGINNING OF THE GAME).

FIG. 132

TITLE

GROUP 7
BOSTON

TEAM
ENGLAND I

"MORGAN"

MORGAN $35,000.00 = VALUE OF CAR
$20,000.00 = CREDIT LIMIT

FIG. 148

TITLE

GROUP 7
BOSTON

TEAM
ENGLAND II

"STERLING"

STERLING $35,000.00 = VALUE OF CAR
$20,000.00 = CREDIT LIMIT

FIG. 149

TITLE

GROUP 8
DETROIT

TEAM
USA I

"CADILLAC"

CADILLAC ALLANTE $56,000.00 = VALUE OF CAR
$40,000.00 = CREDIT LIMIT

FIG. 150

BOARD GAME APPARATUS

BACKGROUND

This board game apparatus, referred to by the name of RALLYE, is a highrisk racing game for two to six players. The apparatus comprises a gameboard, pawns, a scoreboard, pegs, title cards, Rallye cards, number cards and scrip money. The object of the game is to collect points and record such collected points by pegging same on the scoreboard. The first player to peg 100 points on the scoreboard wins the game.

BRIEF DESCRIPTION OF THE DRAWINGS

FIGS. 2 and 3 show the nomenclature lists which identify, in consecutive numerical order, the 155 spaces of the gameboard shown in FIG. 1;

FIGS. 4–132 show each of the Rallye cards;

FIG. 136–165 show each of the title cards;

DESCRIPTION OF THE PREFERRED EMBODIMENT

Figure 1:
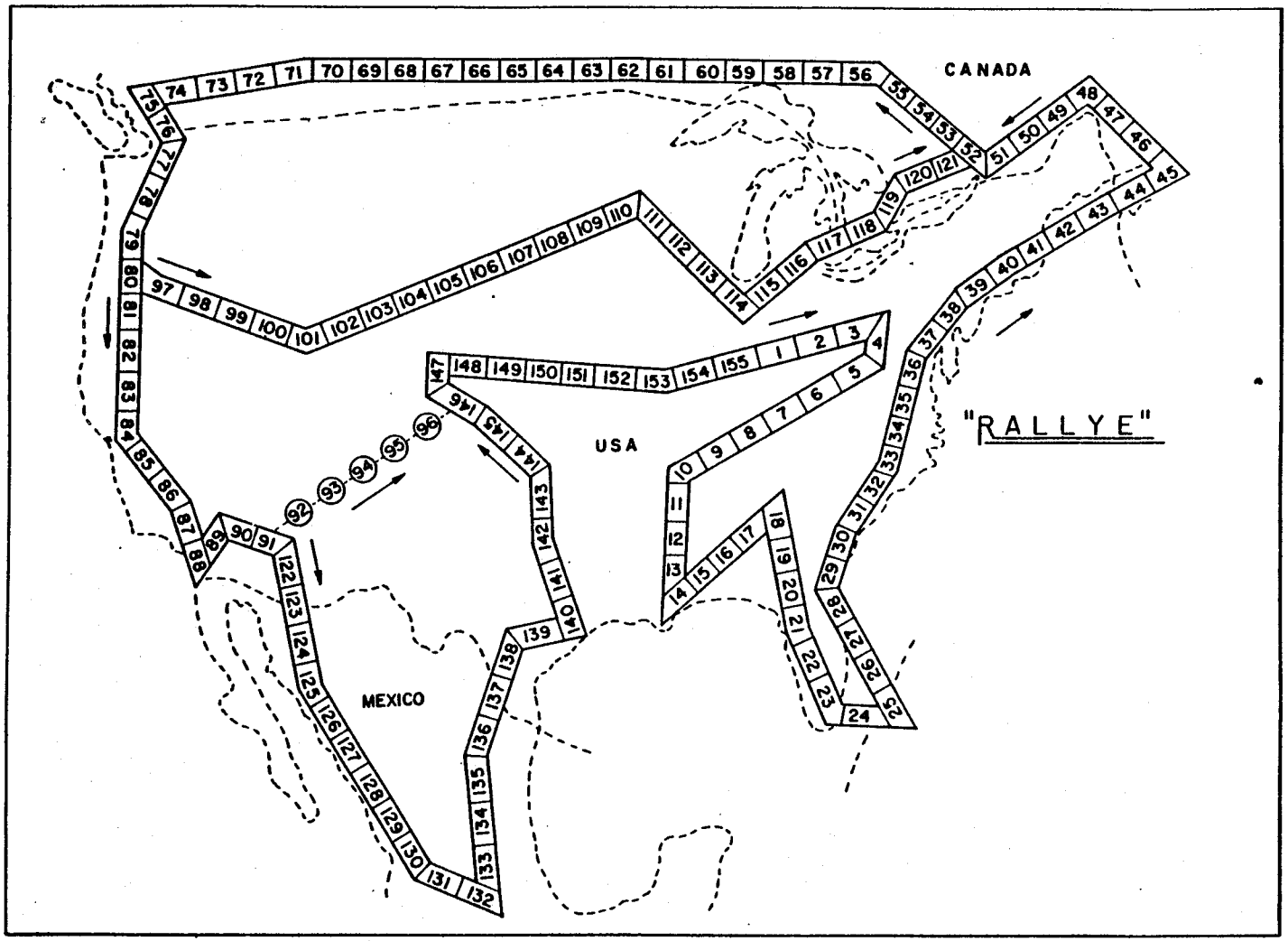
FIG. 1 shows the gameboard of the invention.
Figure 166:
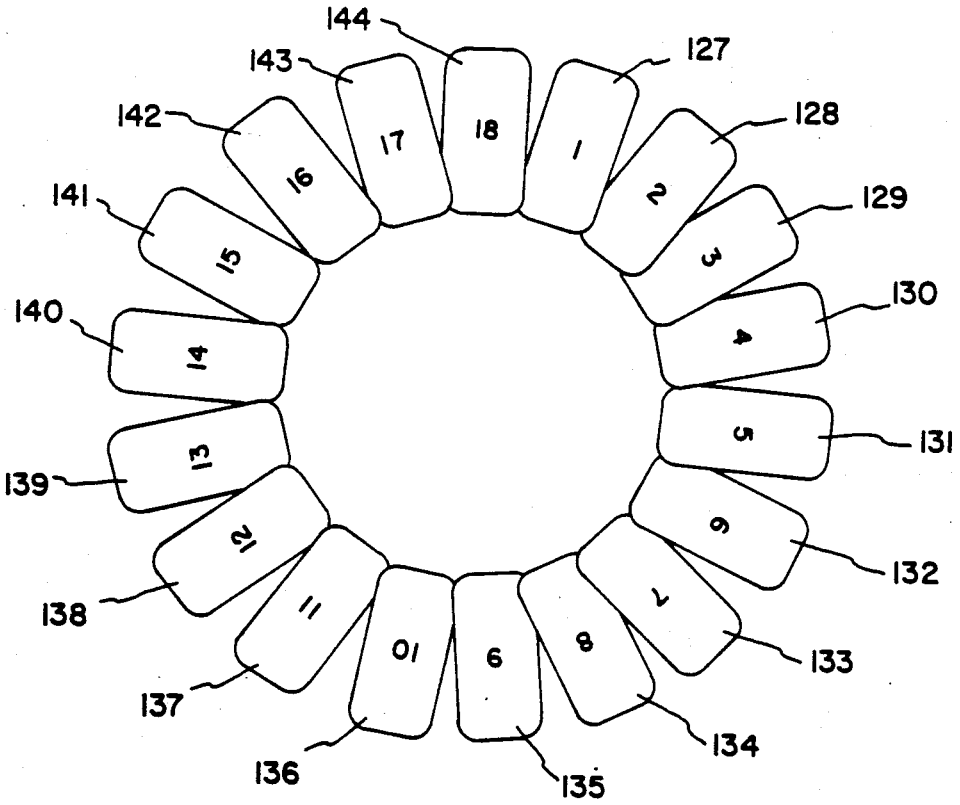
FIG. 166 is a fantail-arranged view of the eighteen number cards.
Figure 134:
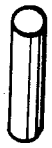
FIG. 134 is a view of one of the colored pegs.
Figure 133:
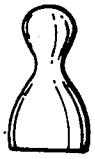
FIG. 133 is a view of one of the colored pawns.
Figure 135:
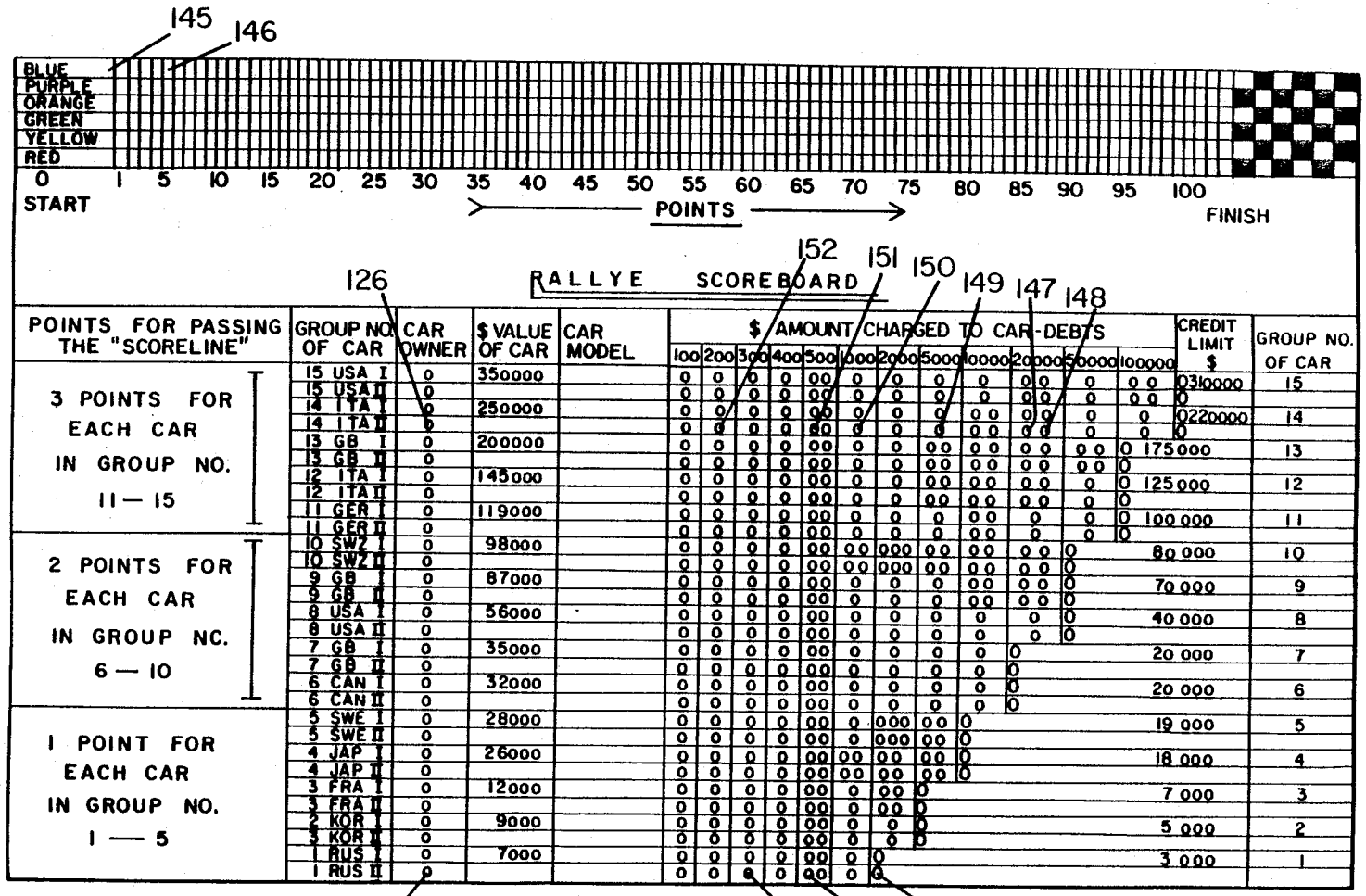
FIG. 135 shows the scoreboard.
Figure 136:
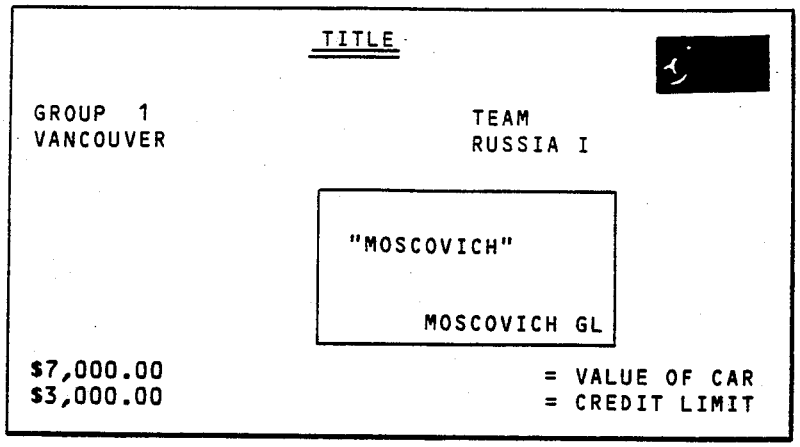
Figure 137:
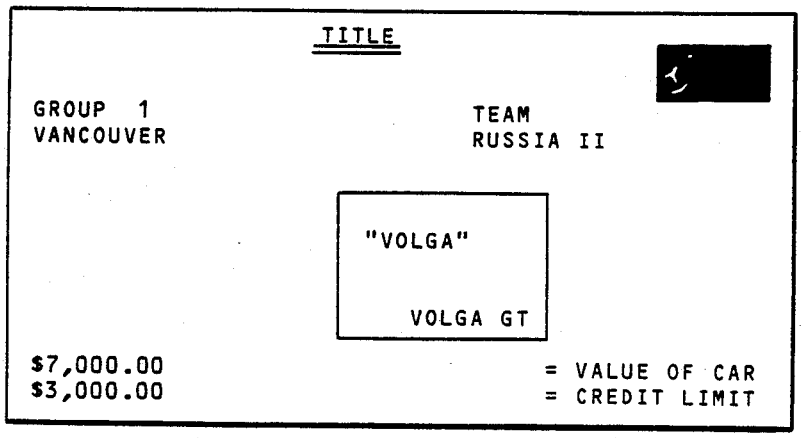
Figure 138:
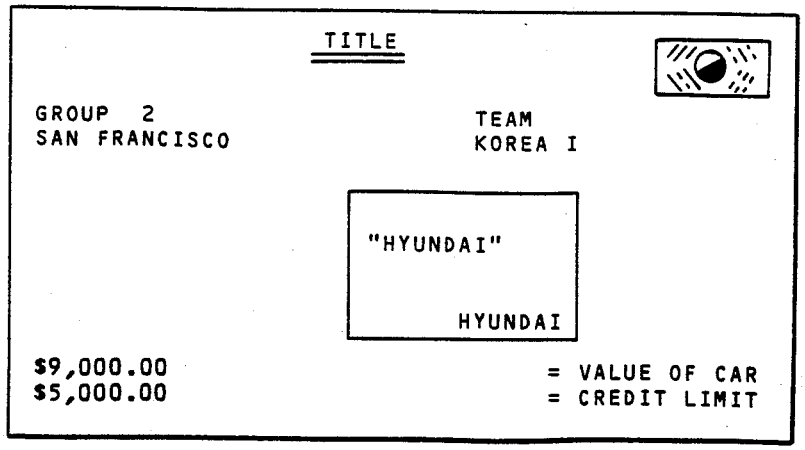
Figure 140:
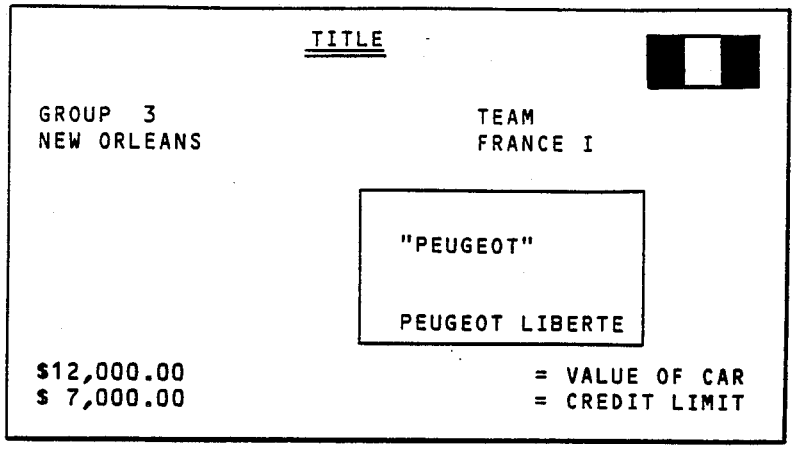
Figure 141:
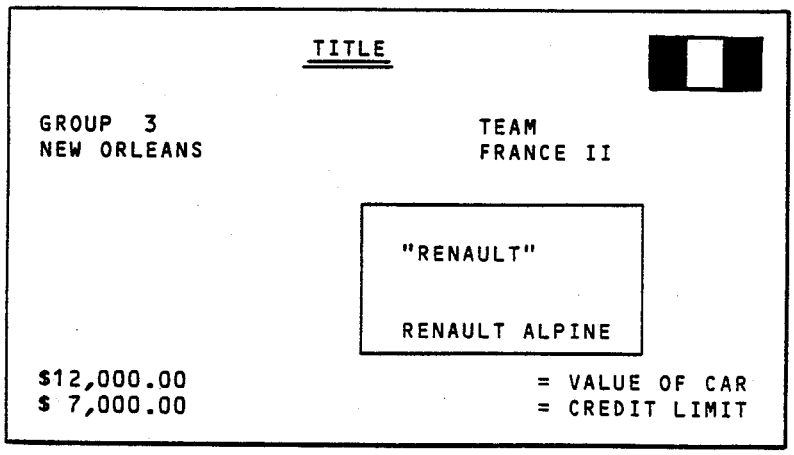
Figure 139:
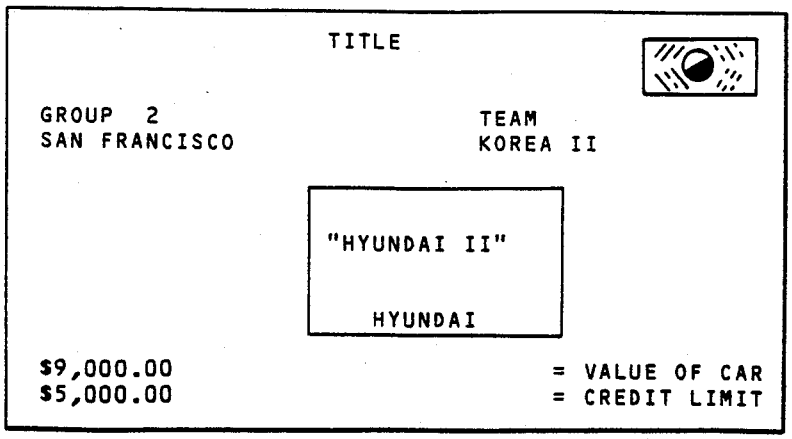
Figure 142:
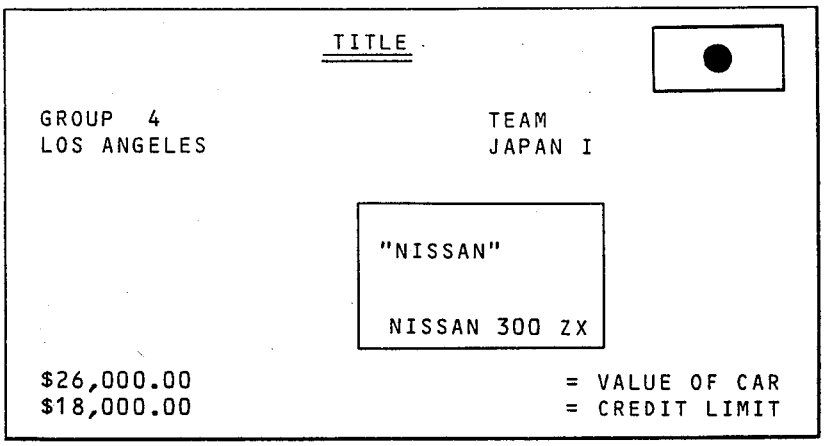
Figure 143:
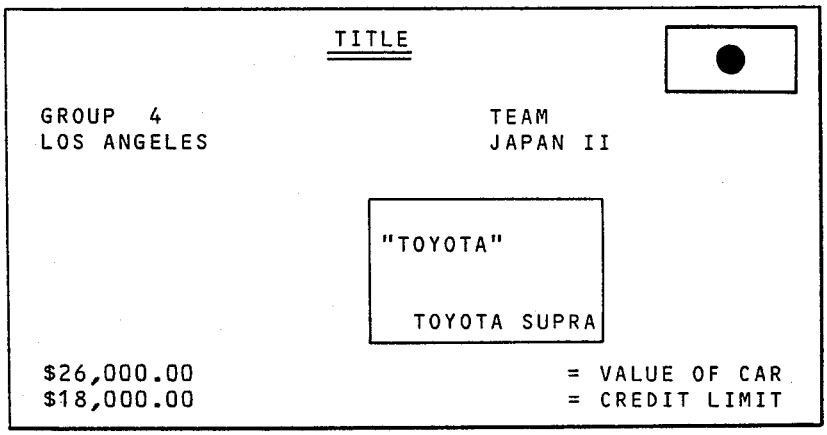
Figure 144:
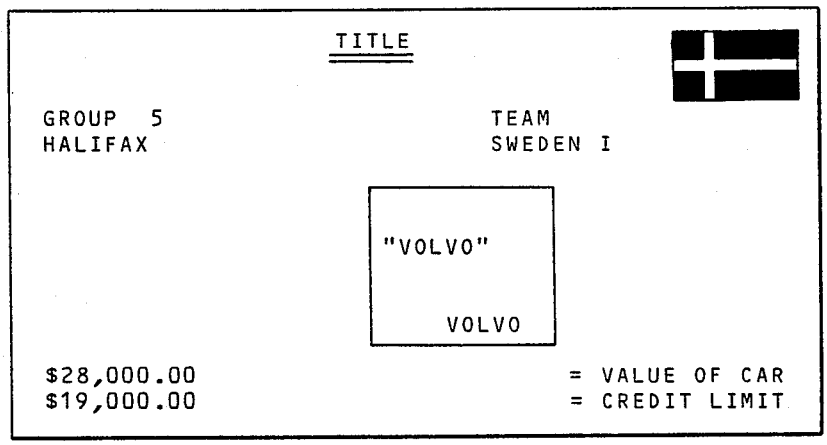
Figure 145:
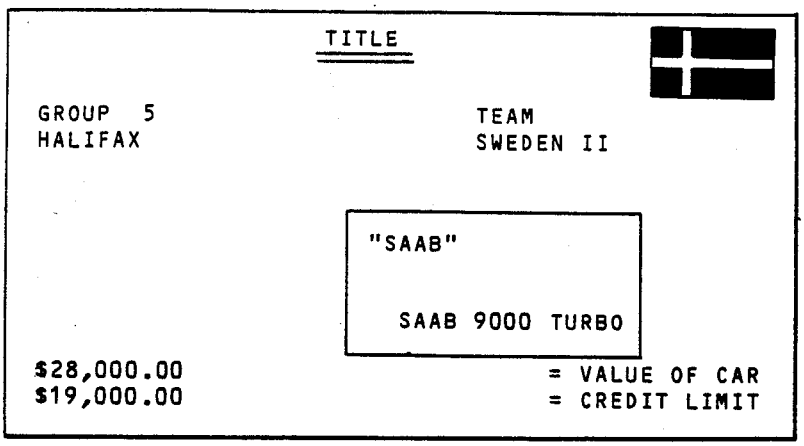
Figure 146:
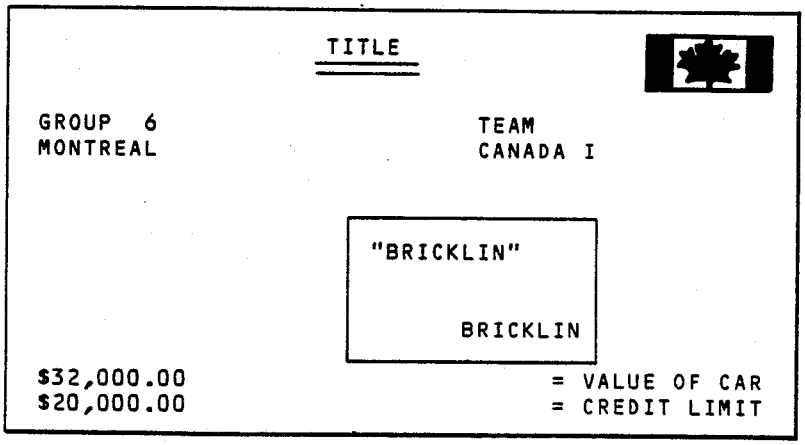
Figure 147:
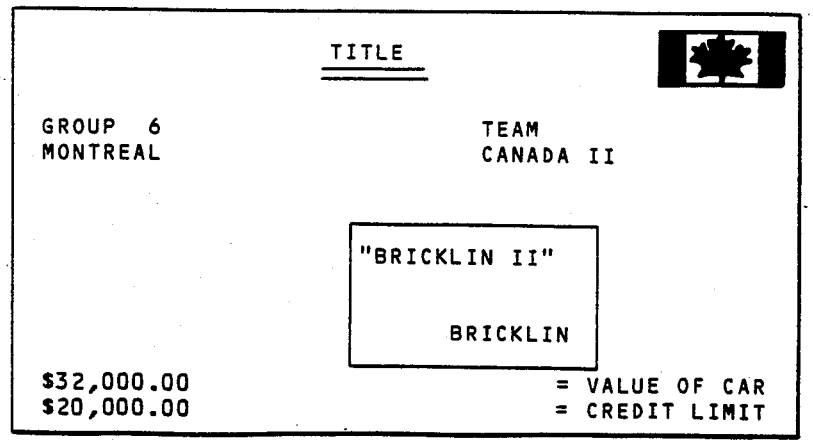
Figure 151:
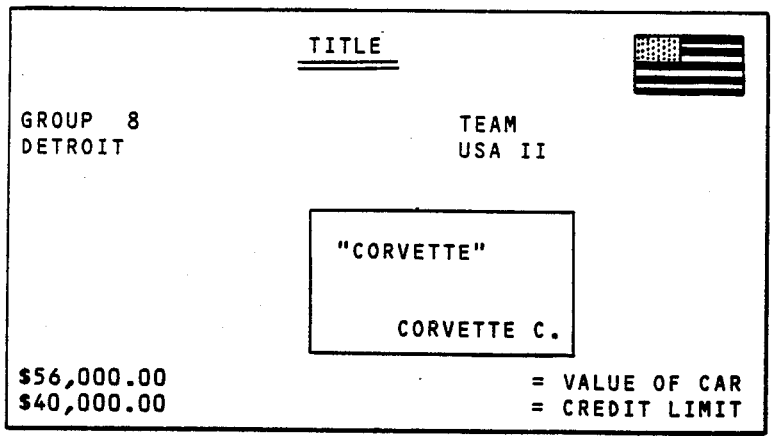
Figure 152:
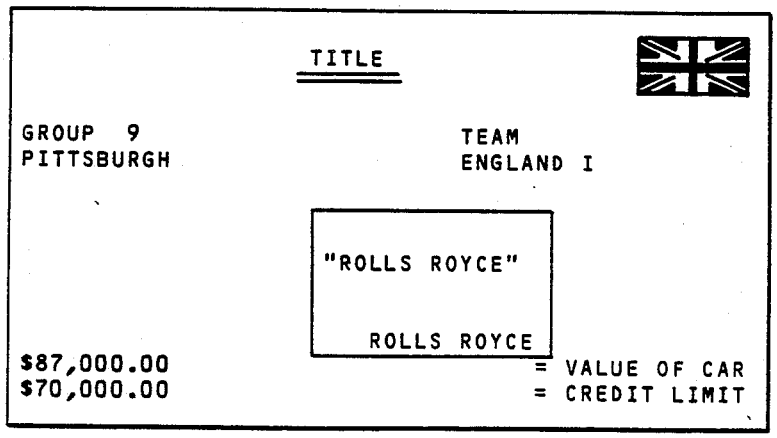
Figure 153:
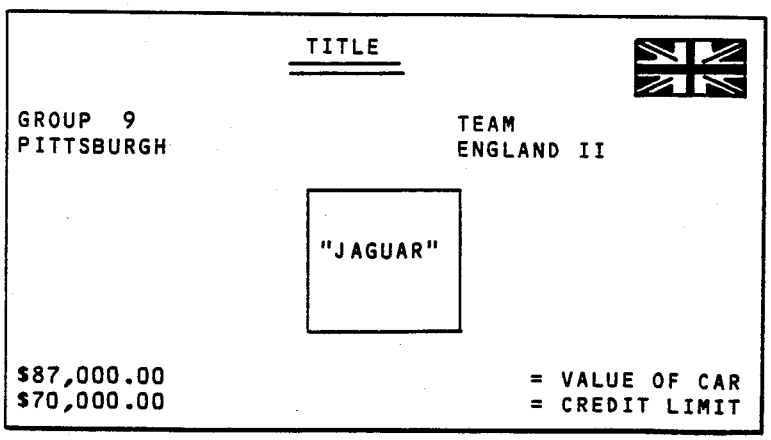
Figure 154:
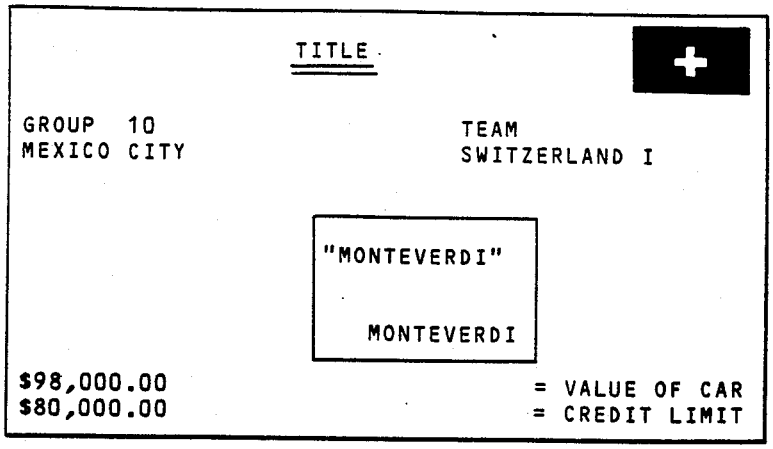
Figure 155:
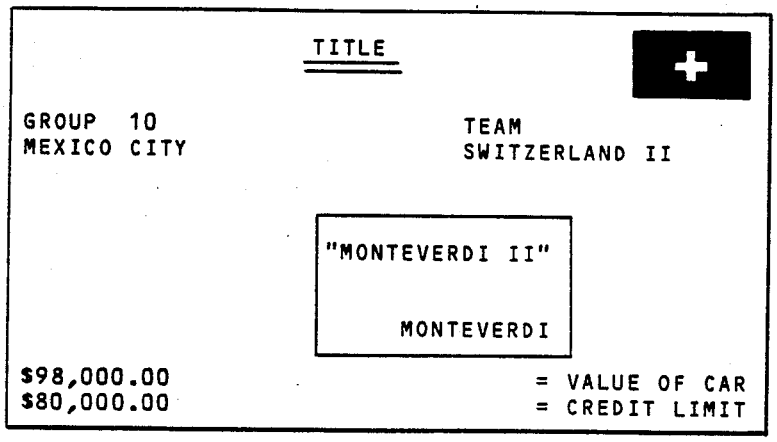
Figure 156:
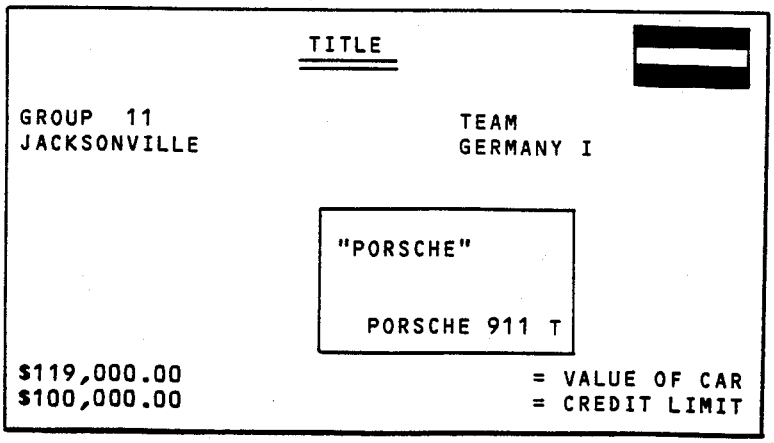
Figure 157:
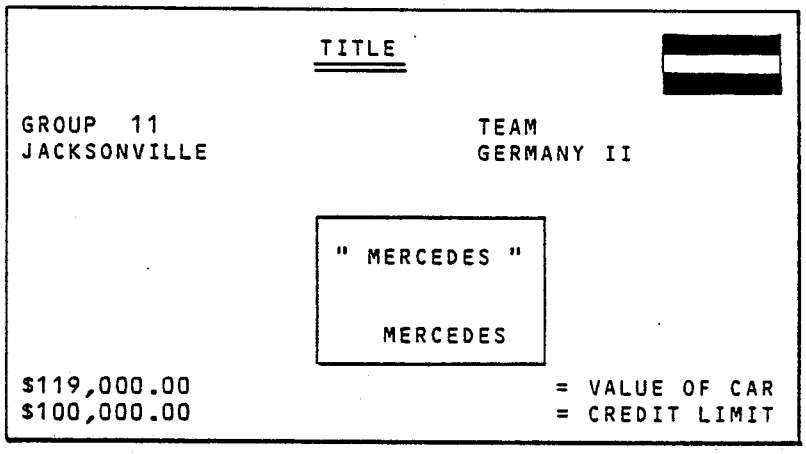
Figure 158:
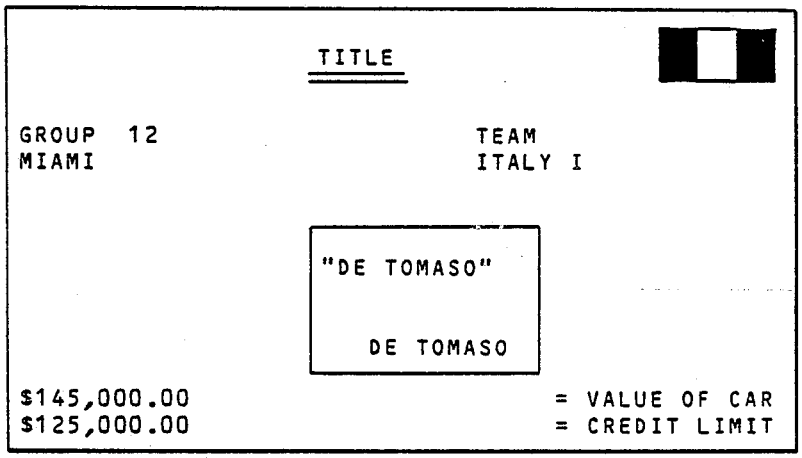
Figure 159:
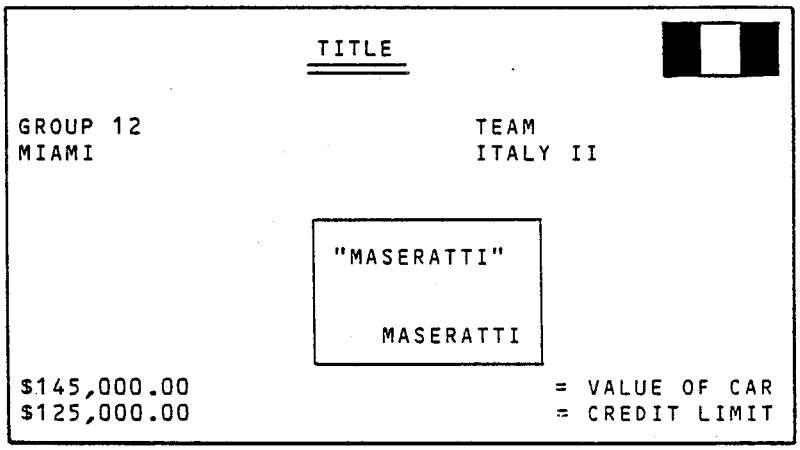
Figure 160:
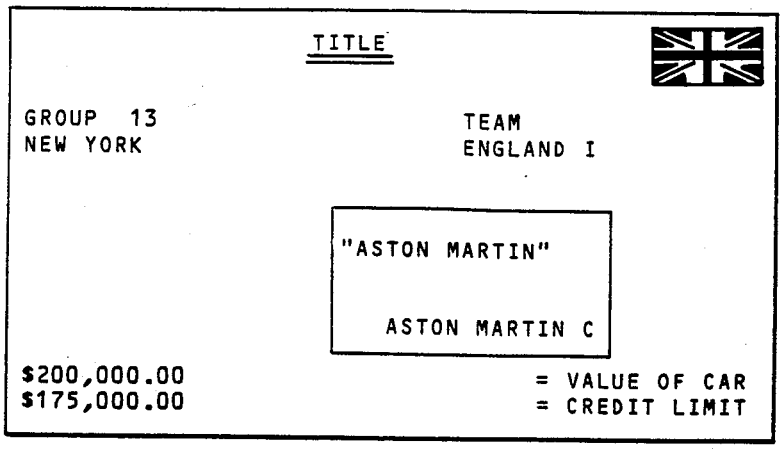
Figure 161:
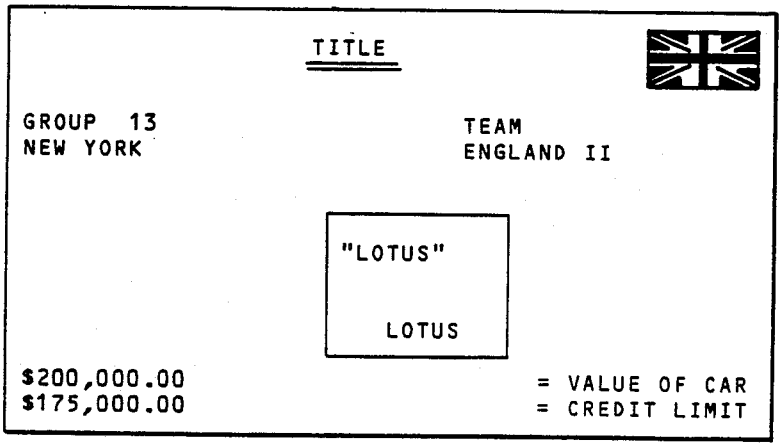
Figure 162:
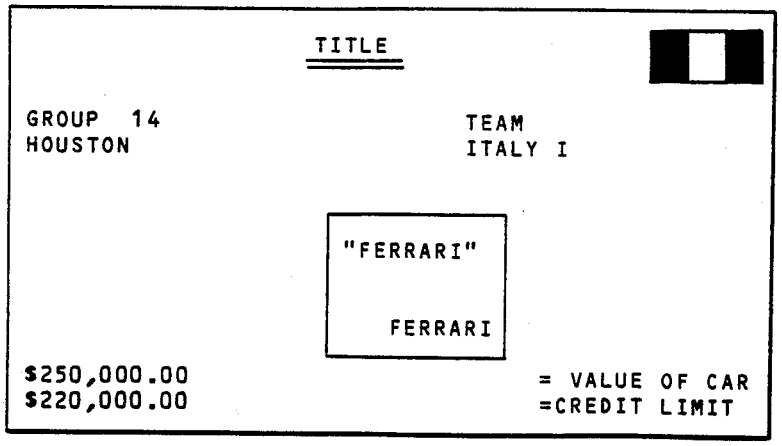
Figure 163:
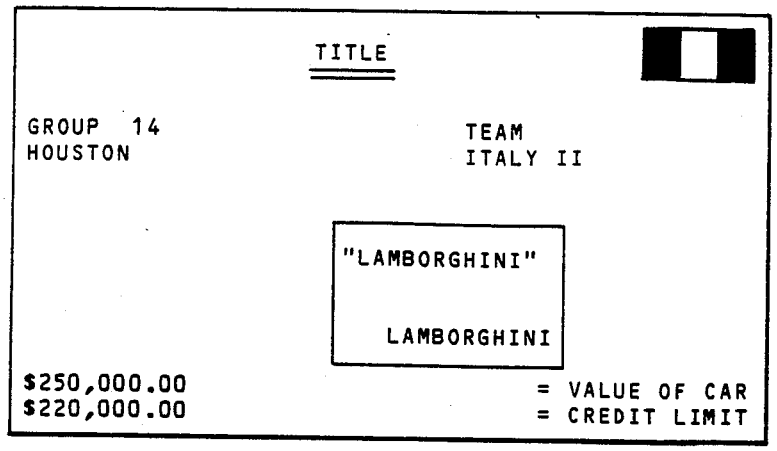
Figure 164:
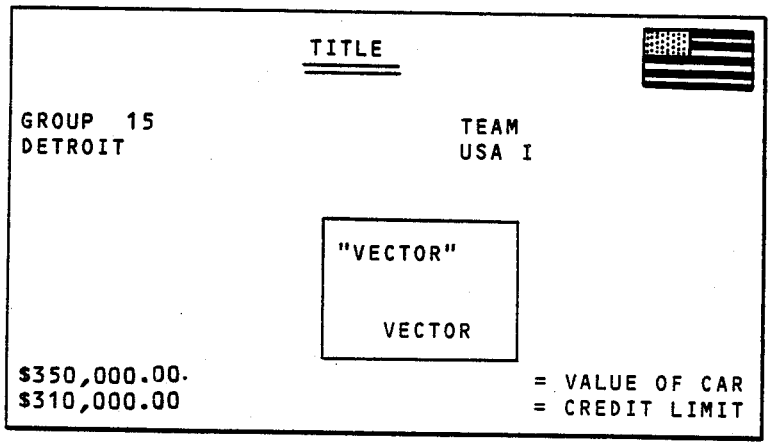
Figure 165:
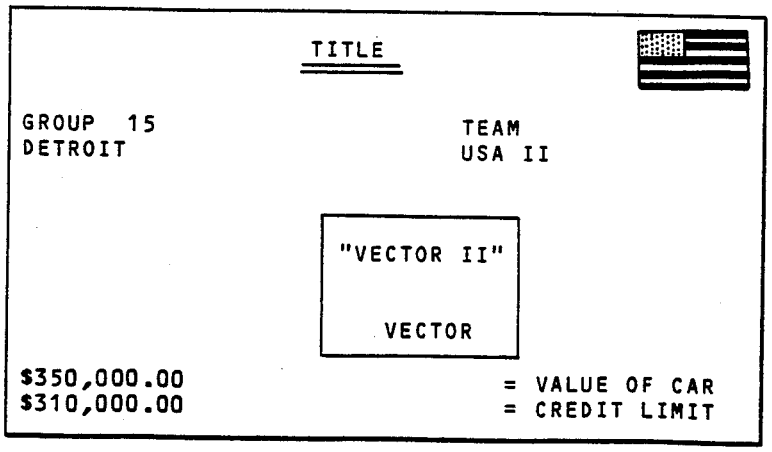
Figure 167:
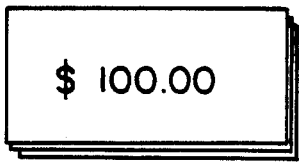
FIGS. 167–178 show the scrip money for the respective amounts of $100, $300, $500, $1,000, $3,000, $5,000, $10,000, $30,000, $50,000, $100,000, $300,000 and $500,000.
Figure 168:
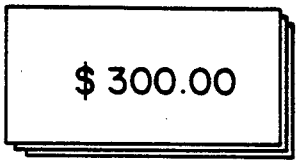
Figure 169:
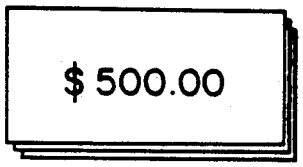
Figure 170:
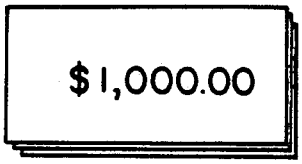
Figure 171:
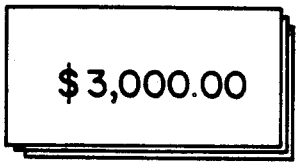
Figure 172:
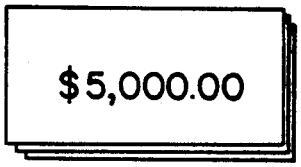
Figure 173:
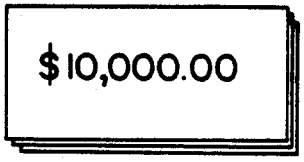
Figure 174:
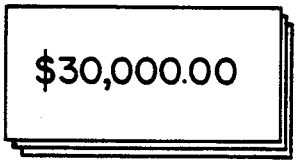
Figure 175:
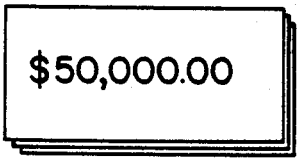
Figure 176:
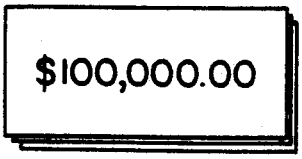
Figure 177:
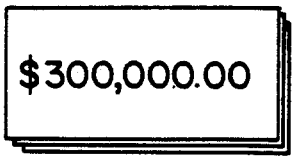
Figure 178:
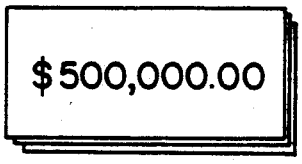

As shown in FIG. 1, the gameboard has enumerated thereon 155 separate and distinct spaces, including a "Start" space 1 and a "Score-Line" space 154. When a player's pawn, as shown in FIG. 133, lands upon or crosses the "Score-Line" space 154, he collects points which he records by correspondingly advancing his peg, as shown in FIG. 134, the same number of points on the upper portion of the scoreboard, as shown in FIG. 135. When a player's pawn advances on the gameboard and lands upon one of its colored spaces, he must pick the top card of the deck of Rallye cards, as shown in FIGS. 4–132. A Rallye card may automatically award a player, and/or other players, bonus points; or the option of earning or collecting bonus points. Such picked Rallye card may automatically deduct points from a player's score; or deduct points from another player's score, or deduct points from other players'-scores. Such picked Rallye card may provide for the exercise of the option by a player and other players by virtue of which points are deducted from the leading player's score to delay such leading player in or prevent him from winning the game. A picked Rallye card may provide for points to be deducted from a player's score if he is unable to or refuses to discharge a primary duty. A player, landing on Las Vegas space 90 on the gameboard, as is provided for in a particular Rallye card picked by such player, may gamble to win points or, if unfortunate, lose points.

While racing on the gameboard throughout the United States, Canada and Mexico, each player will be confronted, from time to time, with various situations, such as opportunities to purchase cars, financial decisions, debt problems, unexpected travelling, physical or mental exercises, good news, bad news, etc.

Before beginning the game, the players elect amongst themselves the following officials:

a. A Race-Committee Chairman who renders final binding decisions in case of any dispute, issue or question that may arise.

b. A Secretary who takes charge of the scoreboard, title cards, Rallye cards and number cards.

c. A Treasurer who takes charge of the scrip money, disburses money to the players and receives money from the players.

d. An Auctioneer who takes charge of the auctioning off of cars and the bidding for cars.

Each player selects a pawn and pegs or pins that are of the same color and which are used exclusively by such player for the duration of the game to represent his racing team. All the players place their respective color pawns on "Start" space 1 on the gameboard and each player collects $100,000 in scrip money from the Treasurer.

The Secretary shuffles, face-down, the title cards to the cars and each player picks blind two title cards representing such player's ownership to the two cars initially donated by a generous sponsor. Each of the players marks his ownership and possession of the two cars initially donated to him by sticking his colored peg in the spot on the scoreboard for the group number and its respective team or car number for each of the two cars. Each time a player thereafter acquires another car, he follows the same procedure. For example, a player who selected a red colored pawn and red colored pegs and who is the owner of a Ferrari in group 14 and team or car number I would stick one of his red colored pegs in the spot indicated by reference numeral 126 on the scoreboard shown in FIG. 135.

The Secretary shuffles, face-down, the Rallye cards and another player cuts the deck. Next, the Secretary shuffles, face-down, the number cards and another player cuts the deck. There are eighteen number cards, 127, 128, 129, 130, 131, 132, 133, 134, 135, 136, 137, 138, 139, 140, 141, 142, 143 and 144, bearing discrete numbers from 1 to 18, as shown. The Secretary deals, from the top of the deck, one number card face-up to each player. The player, dealt the highest number card, plays first; the player, dealt the next highest number card, plays second, etc.; thereafter determining the "order of play" throughout the game. The dealt number cards are returned to the deck, reshuffled and cut. A "round of play" means the opportunity thereafter "in turn", in order of play, to select the top number card from the deck and to advance on the gameboard. One player shuffles, face-down, the deck of number cards. The player whose turn it is to play cuts the deck, picks the top number card, advances the number of spaces on the gameboard corresponding to the number card he picked and then returns his picked number card to the deck. A player, to rest for a round of play, loses his turn for that round of play and must position his pawn beside the last space on the gameboard upon which he landed or to which he was required to move. Similarly, such player may have to rest or wait for two rounds of play. After resting or waiting for such required one or two rounds of play, such player again takes his turn to play in the order of play.

Each player starts with "0" points on the scoreboard and sticks his colored peg in the "0" spot on the upper portion of the scoreboard consistent with the color he initially selected. For example, a player who selected the blue color sticks his blue peg in the "0" spot indicated by reference numeral 145 on the scoreboard and, then, if he collected five points, he would record his score by sticking his blue peg in the spot indicated by reference numeral 146 on the scoreboard.

GAMEBOARD

A player races his racing team around the gameboard from "Start" space 1 to Indianapolis space 155. A player collects points which he records on the scoreboard when he lands upon or passes "Score-Line" space 154. There are fourteen manufacturing or importing cities on the gameboard where cars of a specific group, indicated by its group number, can be purchased or otherwise acquired. These cities are: Pittsburgh space 3, New Orleans space 14, Miami space 23, Jacksonville space 28, New York City space 39, Boston space 41, Halifax space 45, Montreal space 52, Vancouver space 75, San Francisco space 84, Los Angeles space 87, Detroit space 116, Mexico City space 132 and Houston space 140.

Auction spaces 16, 106 and 127 on the gameboard offer players the opportunity to purchase cars by auction to the highest bidder.

A player loses one car of his choice each time his pawn lands upon one of the three crash spaces 81, 82 and 134 on the gameboard.

Each time a player lands upon one of the colored spaces (the black and white drawing FIG. 1 does not show the color) 2, 5, 6, 8, 9, 12, 13, 17, 22, 26, 29, 30, 32, 35, 38, 40, 42, 44, 46, 48, 50, 53, 54, 55, 56, 57, 60, 61, 63, 65, 68, 69, 72, 73, 74, 78, 83, 85, 86, 89, 98, 100, 102, 104, 105, 107, 109, 111, 112, 113, 119, 120, 121, 124, 125, 126, 128, 129, 133, 135, 138, 141, 143, 145, 148, 149 and 152 on the gameboard, such player picks the top Rallye card of the deck and performs the duty, pays the penalty, receives the reward or bonus, or may exercise the option, that such picked Rallye card may provide. The Race-Committee Chairman renders the final binding decision in case any dispute, issue or question may arise in interpreting the meaning and applicability of any Rallye card.

Each time a player lands upon one of the advancement spaces 4, 7, 10, 15, 19, 20, 27, 47, 49, 51, 58, 59, 62, 66, 70, 80, 97, 99, 108, 131, 139, 144, 146 and 150 on the gameboard, such player advances his pawn as directed by the particular advancement space upon which he landed.

There are a number of "no-action" spaces on the gameboard which provide a player landing thereon only the opportunity to rest, to wit: border spaces 24, 43, 76, 117, 123 and 137, and city spaces Memphis 11, Atlanta 18, Tampa 21, Nassau 25, Charleston 31, Charlotte 34, Washington 36, Philadelphia 37, Winnipeg 64, Calgary 71, Seattle 77, Portland 79, San Diego 88, Salt Lake City 101, Minneapolis 110, Chicago 114, Toronto 118, Phoenix 122, Guadalajara 130, Monterrey 136, Dallas 142, Denver 147, Kansas City 151 and St. Louis 153.

Each time a player lands upon one of the money spaces 33, 67, 103 and 115 on the gameboard, such player collects in cash from the Treasurer the amount of money such particular money space directs be paid such player.

When a player lands upon advancement space 80, he has the option of either advancing southward one space to crash space 81 and losing one car of his choice; or of taking the deviation route south of Seattle/Portland and thereafter advancing eastward via spaces 97 through 121 to colored space 152.

When a player lands upon shortcut space 91, he has the option of either paying the Treasurer $5,000 cash and then advancing eastward via shortcut spaces 92, 93, 94, 95 and 96 to advancement space 146; or, he can continue on his southward course via space 122.

When a player lands upon Las Vegas space 90, he has the option of gambling or not gambling for points. If he gambles and wins, points are added to his score on the scoreboard. If he gambles and loses, points are deducted from his score on the scoreboard. A player can wager from one to ten points provided he has already accumulated at least a like number of points on the scoreboard. For example, a player can wager one, two, three, four or five points provided he already has at least five points on the scoreboard. Such player both states in advance the number of points he is wagering and predicts whether the number card he will select will be nine or lower, or ten or higher. For example, four points are added to his score on the scoreboard if he wagers four points, has at least four points on the scoreboard, predicts the number card he will select will be nine or lower, and the number card he selects is nine or lower. Likewise, four points are deducted from his score on the scoreboard if the number card he selected was ten or higher.

When a player lands upon Indianapolis space 155, he can race for three additional points to be added to his score on the scoreboard by selecting a number card that is ten or higher; however, he will not lose any points if his selected number card is nine or lower.

RALLYE CARDS

The unknown but exciting factors in the game are the unknown duties, penalties, rewards, options, etc. which befall a player each time he must pick a Rallye card when landing upon one of the colored spaces on the gameboard. Some of the Rallye cards present danger for a player who owns cars that are not fully paid for, but financed. On the other hand, good fortune may shine its light upon a player behind the race to the extent that such player may even emerge as the new leader. As stated previously, the Race-Committee Chairman renders the final binding decision, and for which there is no appeal, in the event a dispute arises as to the interpretation and meaning of Rallye cards selected. Furthermore, no player can raise the question of conflict of interest when the Race-Committee Chairman exercises his authority to render his final binding decision even when the Race-Committee Chairman has a personal interest in the dispute. Therefor, it behooves the players to elect as their Race-Committee Chairman a player who is fair and impartial.

SCOREBOARD

The scoreboard provides a current record of (a) the financial situation of each player, (b) the number of cars each player owns and has financed, (c) cars available for acquisition and (d) the total points accumulated by each player.

(a) The financial situation of each player

A player can handle payments for expenses by either paying cash to the Treasurer or by financing such expenses to cars in his possession, thus increasing his debt, but saving his cash for the purchase of other cars.

For example, the red team player, owning the Ferrari in group 14 and team or car number I, can simply pay off $20,000 of expenses by charging such amount to debt by sticking one of his red pins in the spot indicated by reference numeral 147 on the scoreboard. The red team player can similarly pay off $40,000 of expenses by sticking one red pin in the spot indicated by reference numeral 147 on the scoreboard and by sticking another red pin in the spot indicated by reference numeral 148 on the scoreboard. If the red team player had to pay off $46,700 of expenses, he would stick additional red pins in the spots indicated by reference numerals 149, 150, 151 and 152 on the scoreboard. Of course, when the red team player pays part or all of the debt he has charged by paying cash to the Treasurer, he would correspondingly remove the requisite number of red pins to indicate what debt remains charged against his Ferrari.

Assuming for purposes of further example that the red team player also purchases for $7,000 a Volga car in group 1 bearing team or car number II and finances his purchase to such car's credit limit: the red team player would pay the Treasurer $4,000 cash, stick a red pin in the spot indicated by reference numeral 153 on the scoreboard to indicate his ownership of such Volga car and stick another red pin in the spot indicated by reference numeral 154 on the scoreboard to indicate that he has financed $3,000 of the Volga's purchase price.

If the red team player wants to pay off $2,200 of the $3,000 debt he had financed on his Volga car to leave a financed debt balance of $800, the red team player must pay the Treasurer $2,200 cash, remove the red pin from the spot indicated by reference numeral 154, and then insert red pins in the spots indicated by reference numerals 155 and 156.

A player can not generate cash by financing debt on his car(s), nor can he transfer financed debt from one car to another. He can only discharge expenses by debt financed to his car(s) and for which he never receives cash from the Treasurer because, by financing such requisite debt to his car(s), his expenses are liquidated as an internal paper transaction and not a cash transaction. If a player's car(s) is (are) fully financed and he has insufficient cash on hand with which to pay the Treasurer for expenses or mandatory obligations that arise, such player may be forced to surrender to the Secretary title card(s) to his car(s) or go bankrupt. When a player goes bankrupt, all his financed debt, expenses and financial obligations are wiped out by surrendering all his remaining cash to the Treasurer and surrendering the title card(s) to his car(s) to the Secretary. Thereupon, each bankrupt player receives $100,000 cash from the Treasurer and the title card to one card from the Secretary by selecting one title card blind. Such bankrupt player loses none of the points he had accumulated on the scoreboard and resumes racing on the gameboard from the space he went bankrupt. When a player purchases a new car or cars at an auction, such bid purchase price(s) can be paid outright by cash payment to the Treasurer, or by combination(s) of part cash payment to the Treasurer with the debt balance financed up to the credit limit(s) of the car(s). If such player lacks sufficient cash to pay the Treasurer the requisite part payment, such player's successful bid price for a car is lost.

(b) The number of cars each player owns and has financed

As previously described, the colored pegs or pins on the scoreboard identify the players who own cars along with the debt for which each car is financed. When a player land upon a crash space on the gameboard and loses a car of his choice, or otherwise loses one or more of his cars, such player decides which car(s) he will lose (unless mandated otherwise). Upon losing a car, the title card for such car is surrendered to the Secretary, its identifying colored peg(s) is (are) removed from the scoreboard and the financed debt for such car is wiped out (unless mandated otherwise). When the crashed or lost car is the only car the player has, the same described procedure applies; however, such player is automatically declared bankrupt, he selects blind a new title card free and clear of debt, receives $100,000 from the Treasurer, resumes racing on the gameboard, but loses none of the points he had accumulated on the scoreboard. If no other car is available, such player retains title to his only car free and clear of any financed debt. Title cards surrendered to the Secretary immediately become available for acquisition.

(c) Cars available for acquisition

The unpegged or unpinned positions on the scoreboard indicate the cars available for acquisition. A player can purchase a car, if available, when his pawn lands upon one of the fourteen spaces on the gameboard where cars can be purchased or acquired. Each one of the fourteen spaces only offers cars of a specific group. To qualify as the owner of a racing team, a player must own both cars of a specific group. To do this, a player must land again on the same identical space before another player landed on the same identical space and purchased a car of that specific group. In the interim, another player may have picked a Rallye card which enables him to purchase the second car of such group, to purchase such second car at an auction, or to receive such second car free.

When a player lands upon one of the three auction spaces 16, 106 and 127, or picks a Rallye card which mandates an auction, the Secretary shuffles the title cards face-down and selects blind a title card or several title cards (if mandated by such picked Rallye card). The Auctioneer takes over and announces the car(s) that will be auctioned off. All players have the opportunity to bid for one car at a time. The accepted bid price often exceeds the car's value. In any event, for the successful bidder to acquire title to a car, he must either pay the Treasurer the unfinanced balance the bid price in cash, or finance up to the car's maximum credit limit and pay the Treasurer in cash. The successful bidder is eliminated from the auction and has to pay a $5,000 cash penalty or surrender all his remaining cash to the Treasurer if the successful bidder can not or refuses to complete the car purchase at the bid price. In this event, the remaining unsuccessful bidders start the bidding over for the car; however, if nobody wants to pay the new auctioned-off price for the car, the Secretary takes back the title card for that car. When there are only two players in the game, the unsuccessful bidder acquires the auctioned-off car for a minimum $100 purchase price if the successful bidder can not complete the car purchase and, in which event, the original successful bidder is eliminated from the auction and must pay the Treasurer a $5,000 cash penalty or surrender all his remaining cash to the Treasurer.

(d) The total points accumulated by each player

Each time a player lands upon or passes the "Score-Line" space 154, he collects one point for each car he owns in groups 1–5, two points for each car in groups 6–10 and three points for each car in groups 11–15, and one bonus point for each racing team owned by such player. A player owning two cars in group 14 would collect three points for each car, plus one bonus point for owning a racing team for a total of seven points.

TITLE CARDS

Thirty title cards are available, divided into fifteen groups with two cars in each group. Each title card has the following information: the group number, the team or car number for that group, the country of origin, the city where the car is manufactured or can be acquired, name/model for the car, value of the car and the credit limit for financing or charging debt.

Having thusly described my invention, I claim:

1. In combination, a board game apparatus comprising: a gameboard, pawns for two to six players with each player having a separate and distinct pawn, each of said pawns being the means by which a player contemporaneously races and moves the cars he owns on said gameboard, rallye cards, scrip money, number cards bearing discrete numbers thereon, a scoreboard, pegs for two to six players with each player having separate and distinct pegs, and title cards; said gameboard being provided with a playing area having interconnected routes throughout the United States, through Canada and through Mexico, said interconnected routes having separate and distinct enumerated spaces by means of which a player moves his pawn on said gameboard, said pawns being the means by which all the players race all their cars contemporaneously and indicate their respective moves on said gameboard, said enumerated spaces defining a start space upon which the players place their respective pawns to start the game, spaces where a car of a specific group, if available, can be purchased upon a player's pawn landing thereon, spaces where, upon a player's pawn landing thereon, one of the players with the highest bid has the opportunity to acquire a car by auction, spaces where a player loses a car of his choice upon his pawn landing thereon, spaces where a player, upon his pawn landing thereon, must pick one of said rallye cards imposing duties or penalties, providing rewards or bonuses, or providing exercisable options, spaces where a player, upon his pawn landing thereon, advances his pawn on said gameboard as directed by such space, spaces where a player, upon his pawn landing thereon, merely rest his pawn, spaces where a player, upon his pawn landing thereon, collects money, spaces where a player, upon his pawn landing thereon, has the option of continuing on his course or taking a different route, a space where a player, upon his pawn landing thereon, has the option of gambling for points, a space where a player, upon his pawn landing thereon, races only to collect bonus points, a score-line space where a player, upon his pawn landing thereon or passing same, collects points, a player, at his turn in the order of play, picking one of said number cards and advancing his pawn the number of spaces on said gameboard corresponding to the discrete number on said number card, said scoreboard having indicia thereon by which each of the players records his accumulated point score, said pegs being utilized by the players to record their respective accumulated point scores on said scoreboard, said scoreboard having further indicia thereon by which ownership of the cars is indicated, the value of each car is indicated and the credit limit for financing or charging debt to each of said owned cars is indicated, said pegs further being utilized by the players to indicate on said scoreboard their respective ownership of said cars and the extent to which the players financed or charged debt to their respectively owned cars, said scrip money being the means by which the players purchase cars outright or by part payment, pay penalties, exercise options, pay expenses or mandatory obligations, each of said title cards possessed by a player representing said player's ownership of one of said cars and indicating the group number of each car, team number of each car in said group, the car's country of origin, the city where each said car is manufactured or can be acquired, the name/model of said car, the value of said car, and the credit limit for financing or charging debt to said car, and the game being won by the first player to collect and accumulate a certain number of points on said scoreboard.

2. A board game apparatus in accordance with claim 1, wherein there are 155 separate and distinct enumerated spaces on said gameboard.

3. A board game apparatus in accordance with claim 1, wherein there are 14 spaces where a player, upon his pawn landing thereon, can purchase a car of a specific group, if available.

4. A board game apparatus in accordance with claim 1, wherein there are 3 spaces where, upon a player's pawn landing thereon, one of the players with the highest bid has the opportunity to acquire an auctioned-off car.

5. A board game apparatus in accordance with claim 1, wherein there are 3 spaces where a player, upon his pawn landing thereon, loses a car of his choice.

6. A board game apparatus in accordance with claim 1, wherein there are 67 spaces where a player, upon his pawn landing thereon, must pick one of said rallye cards.

7. A board game apparatus in according with claim 1, wherein there are 24 spaces where a player, upon his pawn landing thereon, advances his said pawn as directed by said space.

8. A board game apparatus in accordance with claim 1, wherein there are 30 spaces where a player, upon his pawn landing thereon, merely rests his said pawn.

9. A board game apparatus in accordance with claim 1, wherein there are 4 spaces where a player, upon his pawn landing thereon, collects money.

10. A board game apparatus in accordance with claim 1, wherein said indicia on said scoreboard by which each of the players records his accumulated point score is consecutively numbered from zero to 100 and wherein the first player to collect and accumulate 100 points on said scoreboard wins the game.

11. A board game apparatus in accordance with claim 1, wherein the points collected by a player upon his landing upon or passing said score-line space on said gameboard is based upon the number of cars said player owns.

12. A board game apparatus in accordance with claim 11, wherein thirty cars are available for acquisition divided into fifteen groups with two cars in each said group, wherein said fifteen groups are subdivided into enumerated groups 1–5, 6–10 and 11–15, and wherein each time a player's pawn lands upon or passes said score-line space, said player collects one point for each car said player owns in groups 1–5, two points for each car said player owns in group 6–10 and three points for each car said player owns in group 11–15.

13. A board game apparatus in accordance with claim 12, wherein ownership by a player of two cars in an enumerated group qualifies said player as being the owner of a racing team and wherein said player collects one additional point for each racing team said player owns when, each time, said player's pawn lands upon or passes said score-line space on said gameboard.

14. A board game apparatus in accordance with claim 1, wherein there are eighteen number cards and wherein each of said number cards separately bears discrete numbers 1 through 18 thereon.

15. A board game apparatus in accordance with claim 1, wherein said pawns and pegs of said players are of different colors, and wherein said pawn and pegs of each player are of the same color.

16. A board game apparatus in accordance with claim 1, wherein said further indicia on said scoreboard provides in addition a current record of cars available for acquisition.

17. A board game apparatus in accordance with claim 1 wherein when a player picks a rallye card imposing a duty or penalty obligating said player to pay expenses or a penalty, respectively, and wherein said player elected to defray said expenses or penalty by charging debt represented thereby to a car or cars owned by said player, said further indicia on said scoreboard providing a current record of the debt said player elected to defray by charging same to said car or cars currently owned by said player.

* * * * *